US005175561A

United States Patent [19]

Goto

[11] Patent Number: 5,175,561

[45] Date of Patent: Dec. 29, 1992

[54] SINGLE-LAYERED RADIAL LINE SLOT ANTENNA

[75] Inventor: Naohisa Goto, Kawasaki, Japan

[73] Assignee: Radial Antenna Laboratory, Ltd., Tokyo, Japan

[21] Appl. No.: 793,314

[22] Filed: Nov. 15, 1991

[30] Foreign Application Priority Data

| | | | |
|---|---|---|---|
| Aug. 21, 1989 | [JP] | Japan | 1-214318 |
| Nov. 30, 1989 | [JP] | Japan | 1-311405 |
| Jan. 19, 1990 | [JP] | Japan | 2-018480 |

[51] Int. Cl.[5] ..... H01Q 13/10; H01Q 21/20

[52] U.S. Cl. ..... 343/769; 343/771

[58] Field of Search ..... 343/770, 771, 767, 769, 343/785

[56] References Cited

U.S. PATENT DOCUMENTS

| | | | |
|---|---|---|---|
| 2,929,064 | 3/1960 | Kelly | 343/771 |
| 3,235,869 | 2/1966 | Van Atta et al. | 343/785 |
| 4,536,767 | 8/1985 | Rembold et al. | 343/785 |
| 4,581,614 | 4/1986 | LaCourse | 343/771 |

OTHER PUBLICATIONS

Kelly, "Recent Annular Slot Array Experiments", IRE National Convention Report, Part 1, Mar. 18-21, 1957 pp. 144-152.

IEEE Transactions on Antennas and Propagation, vol. AP-33, No. 12, Dec. 1985.

IEEE Transactions on Antennas and Propagation, vol. AP-35, No. 10, Oct. 1986.

IEEE Transactions on Antennas and Propagation, vol. 36, No. 9, Sep. 1988.

IEEE Transactions on Antennas and Propagation, vol. 36, No. 12, Dec. 1988.

1989 Spring National Convention Record, The Institute of Electronics, Information and Communication Engineers, Mar. 28-31, 1989.

Antenna Theory, part 1, Inter-University Electronics Series, vol. 7.

*Primary Examiner*—Michael C. Wimer

*Attorney, Agent, or Firm*—Nikaido, Marmelstein, Murray & Oram

[57] ABSTRACT

An inner-feed-type planar antenna of single-layered structure excited by an axially symmetric mode for propagating radio waves from the center toward the outer periphery within a propagation layer having an antenna surface. If the planar antenna is used for transmission, it is provided with a plurality of coupling slots formed and arrayed in one surface of an axially symmetric mode waveguide member in such a manner that the coupling factor of the external radiation is high at the outer periphery and becomes successively lower as the center is approached. A spiral or ring-shaped terminating slot is provided in the antenna surface at the outer portion of the axially symmetric mode waveguide member. A region not coupled with the outer portion is provided at the center of the antenna surface. Furthermore, the planar antenna is provided with a reflector member arranged along the terminating slot for reflecting a propagating radio wave between the inner and outer portions of the axially symmetric mode waveguide member. A comparatively flat aperture distribution in which the electromagnetic field is uniform can be obtained. In addition, by providing the central portion with a non-radiating region, long-line effect is suppressed and bandwidth enlarged.

11 Claims, 15 Drawing Sheets

SINGLE-LAYERED RADIAL LINE SLOT ANTENNA

This application is a continuation of application Ser. No. 564,257 filed Aug. 8, 1990, now abandoned.

BACKGROUND OF THE INVENTION

This invention relates to a planar antenna and, more particularly, to a planar antenna, referred to as a radial line slot antenna, which is excited by an axially symmetric transverse mode.

Radial line slot antennas are described in a variety of literature. For example, refer to "A Radial Line Slot Antenna for 12 GHz Satellite TV Reception" in IEEE TRANSACTIONS ON ANTENNA AND PROPAGATION, Vol. AP-33, No. 12, December 1985, pp. 1347–1353; "Characteristics of a Radial Line Slot Antenna for 12 GHz Band Satellite TV Reception" in IEEE TRANSACTIONS 0N ANTENNA AND PROPAGATION, Vol. AP-34, No. 10, October 1986, pp. 1269–1272; and "Slot Coupling in a Radial Line Slot Antenna for 12-GHz Band Satellite TV Reception" in IEEE TRANSACTIONS ON ANTENNA AND PROPAGATION, Vol. 36, No. 12, December 1988, pp. 1675–1680.

The planar antennas excited by an axially symmetric mode described in this literature all possess a double-layered structure having two propagation layers. Specifically, a radio wave from a feeder source is supplied to the center of the lower propagation layer, the wave is propagated radially outward along the lower propagation layer, guided to the upper propagation layer at the terminus or outer portion of the lower layer, propagated toward the center along the upper propagation layer and radiated by a number of slots in the process of propagating through the upper propagation layer. Circular polarization and linear polarization are decided by the arrangement of the slots. With this double-layered structure, radio waves propagate from the outer periphery toward the center at the radiating layer (namely the upper propagation layer) having the radiating slot surface. In a case where radio waves excited by an axially symmetric mode thus propagate from the outer periphery toward the center, an inner electromagnetic field f(r) is expressed as follows:

$$f(r) = A \exp\{(\alpha + jk)r\}/\sqrt{r}$$

where A represents a proportional coefficient, k represents a propagation constant, r represents the radius, and $\alpha$ is a proportional coefficient of power radiated per unit length in the radial direction. The coefficient $\alpha$ is a positive value and is referred to as a "coupling factor".

On the other hand, aperture power distribution U(r) at the position of the radius is as follows:

$$\begin{aligned} U(r) &= \alpha\, |f(r)|^2 \\ &= \alpha \exp(2\alpha r)/r \end{aligned}$$

where $\alpha$ is positive. Therefore, this is an arrangement in which it is theoretically easy to obtain an aperture power distribution that is nearly uniform in the radial direction.

Residual radio waves that are not radiated are absorbed by an absorber at the center. However, the sectional area in the traveling direction of the radio waves is small near the center, and therefore the amount of radio waves to be thus absorbed is small. As a result, the antenna is efficient.

However, this double-layered structure has a drawback, namely that manufacture is very difficult. Specifically, it is required that the plate material intervening between the upper and lower propagation layers be so held as not to impede propagation of the radio waves. In addition, it is required that the layer widths of the upper and lower propagation layers be maintained at predetermined values.

From the viewpoint of such manufacture, a single-layered structure in which radio waves are radiated in the course of propagating radially outward from the center is advantageous. When the antenna is excited with axial symmetry in such a single-layered structure, the fed radio waves propagate radially outward from the center and are radiated little by little in the course of such propagation. In a planar antenna excited in an axially symmetric mode, the specification of this application refers to an antenna in which the exciting radio waves propagate from the outer edge toward the center within a propagation layer having a radiating surface as being of the "outer-feed type" (or "outer-excitation type"), and refers to an antenna in which the excited radio waves propagate from the center toward the outer edge within the propagation layer as being of the "inner-feed type" (or "inner-excitation type"), In the antenna of the inner-excitation type, the inner electromagnetic field f(r) within the waveguide is as follows:

$$f(r) = A \exp\{-(\alpha + jk)r\}/\sqrt{r}$$

which is the opposite of the two-layered structure mentioned above, namely the antenna of the outer-excitation type. Even if there is no radiation by means of the radiating slots ($\alpha=0$), the electromagnetic field is very large at the center and weakens as the outer edge of the antenna is approached. Since there is radiation from the radiating slots ($\alpha>0$) in addition to the foregoing, the electromagnetic field weakens sharply the nearer the outer edge of the antenna. Accordingly, with an antenna of the inner-excitation type, it is considered to be very difficult in practice to establish a nearly uniform profile distribution in the radial direction.

Residual radio waves that are not radiated are absorbed at the outer peripheral surface in order to avoid reflection. However, in comparison with the antenna of the outer-feed type, the cross-sectional area is extremely large. Since this absorption becomes loss, it has been considered that, in theory, efficiency is very low in the antenna of the inner-excitation type. For these reasons, it has been thought to be difficult or impossible to obtain a highly efficient, practical planar antenna which uses the inner-excitation method. Another reason is that because of this, much more research has been devoted to planar antennas using the outer-feed method than those using the inner-feed method.

SUMMARY OF THE INVENTION

The inventors have returned to and considered the origin of antenna theory and, as a result, have discovered that a planar antenna having fully satisfactory efficiency can be designed even if the antenna is of the inner-excitation type. Thus, an object of the present invention is to provide an inner-excitation-type planar antenna of single-layered structure having excellent characteristics, in which radio waves can be radiated efficiently from the front surface of the antenna.

In order to attain the foregoing object, a planar antenna according to the present invention is of a configuration in which, when a transmission is made, radio waves fed from the center are radiated from an outer portion while propagating toward the outer periphery. The planar antenna is provided with a plurality of coupling slots formed and arrayed in one surface of an axially symmetric mode waveguide member in such a manner that the coupling factor of the external radiation is high at the outer periphery and becomes successively lower as the center is approached, and a terminating slot, comprising a spiral- or ring-shaped slot, provided in the antenna surface at the terminus of the axially symmetric mode waveguide member. A region not coupled with the outer portion is provided at the center of the antenna surface. Furthermore, the planar antenna is provided with a reflector member arranged along the terminating slot for reflecting a propagating radio wave between the inner and outer portions of the axially symmetric mode waveguide member. If an antenna reciprocity theorem (described later) is applied, the construction of the antenna for receiving purposes can be made the same as that for transmitting purposes.

In accordance with the present invention, when the antenna is fed centrally, the inner electromagnetic field is very large at the central portion and weakens sharply as the periphery of the antenna is approached. However, by making the coupling factor high at the outer periphery and successively lower as the center is approached, as mentioned above, a comparatively flat aperture distribution can be obtained. In addition, when the central portion is provided with a non-radiating region, a long-line effect is suppressed and bandwidth enlarged. On the other hand, antenna gain declines by reducing antenna area. However, the increase in bandwidth is much more pronounced than the decline in gain and therefore characteristics desirable for an antenna can be obtained.

Furthermore, by virtue of the terminating slot and reflector member, reflection toward the interior of the waveguide is reduced or held substantially at zero. This makes it possible to reflect radio waves at the terminus toward the front surface of the antenna. Since radio waves having the same phase as circularly polarized radio waves radiated up to the terminus of the antenna are radiated from the terminating slot, power which would be absorbed when use is made of an absorber can be utilized effectively.

In case of reception, actions and effects similar to those seen with the transmitting antenna can be obtained by the antenna reciprocity theorem.

BRIEF DESCRIPTION OF THE DRAWINGS

FIG. 26(*b*) is a central sectional view of this antenna;

FIG. 26(*c*) is a central transverse sectional view of this antenna;

FIG. 27(*c*) is a diagram showing an equivalent transmission line of these waveguide regions.

DESCRIPTION OF THE PREFERRED EMBODIMENTS

Embodiments of the present invention will now be described in detail with reference to the drawings.

Figure 1:
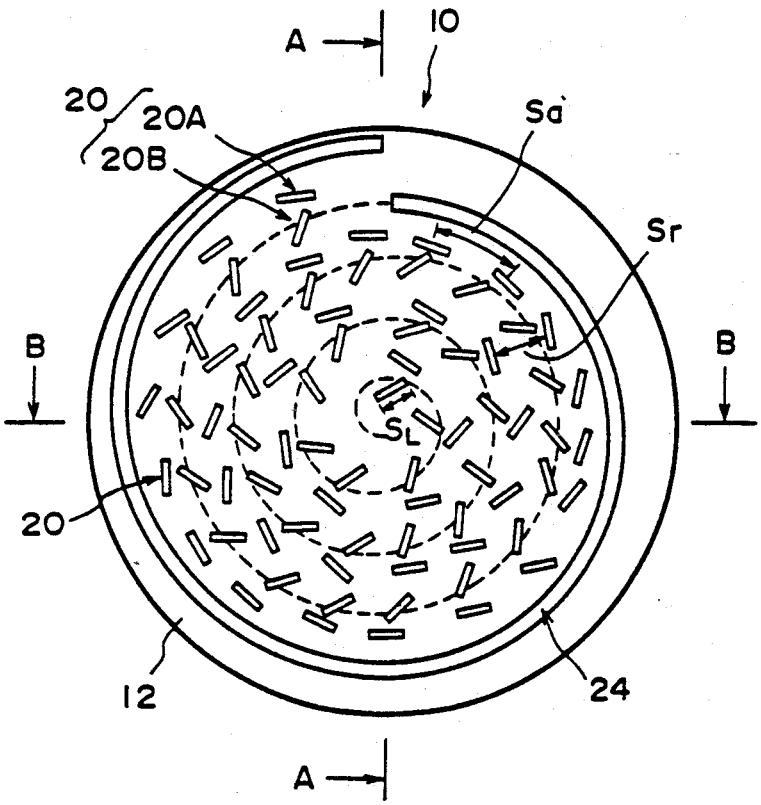
FIG. 1 is a front view of a planar antenna illustrating a first embodiment of the present invention.
Figure 2:
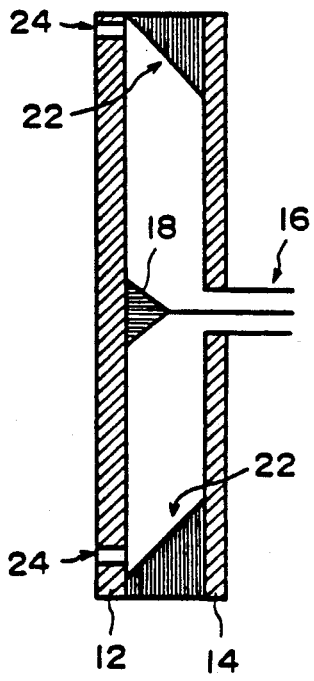
FIG. 2 is a sectional view taken along line A—A of FIG. 1.
Figure 3:
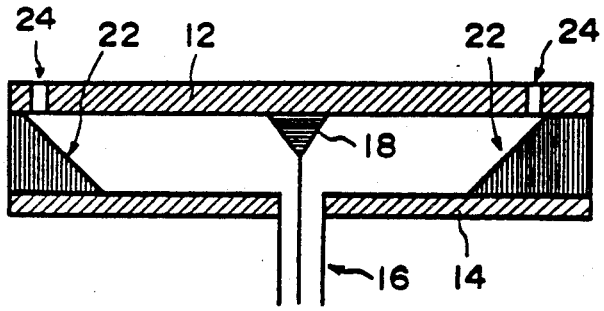
FIG. 3 is a sectional view taken along line B—B of FIG. 1.

As shown in FIGS. 1 through 3, a planar antenna 10 has a circular upper plate (radiating plate) 12 and a circular lower plate 14, and a waveguide for propagation in an axially symmetric mode is formed between these plates. The upper and lower plates 12, 14 each may consist entirely of an electrically conductive material or at least the surface thereof may be coated with an electrical conductor. The space between the upper and lower plates 12, 14 may be filled with air or a prescribed dielectric. The upper and lower plates 12, 14 are held at a fixed spacing by dielectric filling or a member that is not shown, or by the strength of the upper and lower plates 12, 14 themselves. A coaxial cable 16 is connected to the center of the lower plate 14, and a matching reflector 18, which causes radio waves from the coaxial cable 16 to be directed radially outward, is attached to the central portion of the upper plate 12 on the inner surface thereof (the surface facing the lower plate 14). It will suffice if at least the surface of the matching reflector 18 serves as the surface for reflecting the radio waves.

Figure 10:
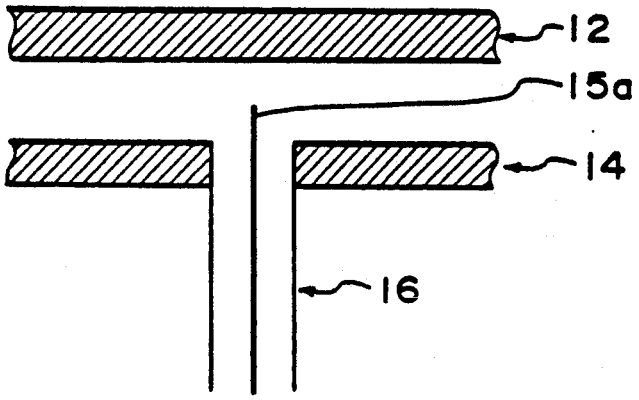
FIGS. 10 and 11 are sectional views illustrating modifications of a central feed portion of the planar antenna.
Figure 11:
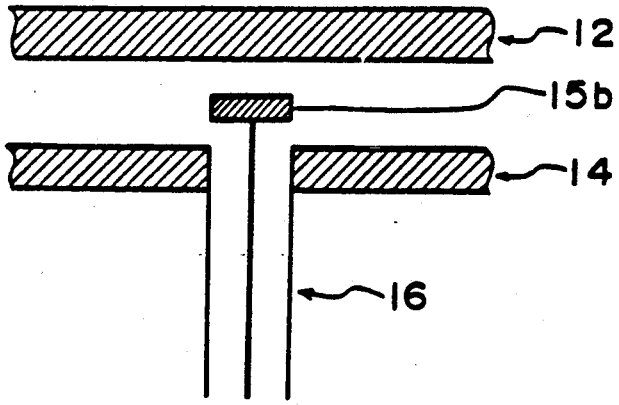

Structures of the kind shown in FIGS. 10 and 11 may be employed instead of the matching reflector 18 as structures for introducing the propagating radio waves from the coaxial cable 16 to the waveguide between the upper and lower plates 12, 14. More specifically, a cylindrical probe 15*a* can be adopted, as shown in FIG. 10, or a disk-type probe 15*b* can be used, as shown in FIG. 11. (For example, refer to "A Probe-Shaped Coaxial-Radial Line Adapter" by Makoto Natori, Makoto Ando and Naohisa Goto in the 1989 SPRING NATIONAL CONVENTIONAL RECORD, THE INSTITUTE OF ELECTRONICS, INFORMATION AND COMMUNICATION ENGINEERS, p. 2-83.)

Radiating slot pairs 20, each of which has two radiating slots 20A, 20B arranged so as to be spatially and electrically perpendicular, are arrayed in the form of a spiral on the radiating surface of the upper plate 12. For the sake of reference, the spiral line is indicated by a dashed line in FIG. 1. By adopting such a slot array, circular polarization having the same phase can be obtained at the front surface of the antenna.

As described earlier, radio waves of an axially symmetric mode which propagate along the waveguide formed by the upper and lower plates 12, 14 vary as a function of radius r as follows:

$$f(r) = A \exp\{-(\alpha + jk)r\}/\sqrt{r}$$

Figure 4:
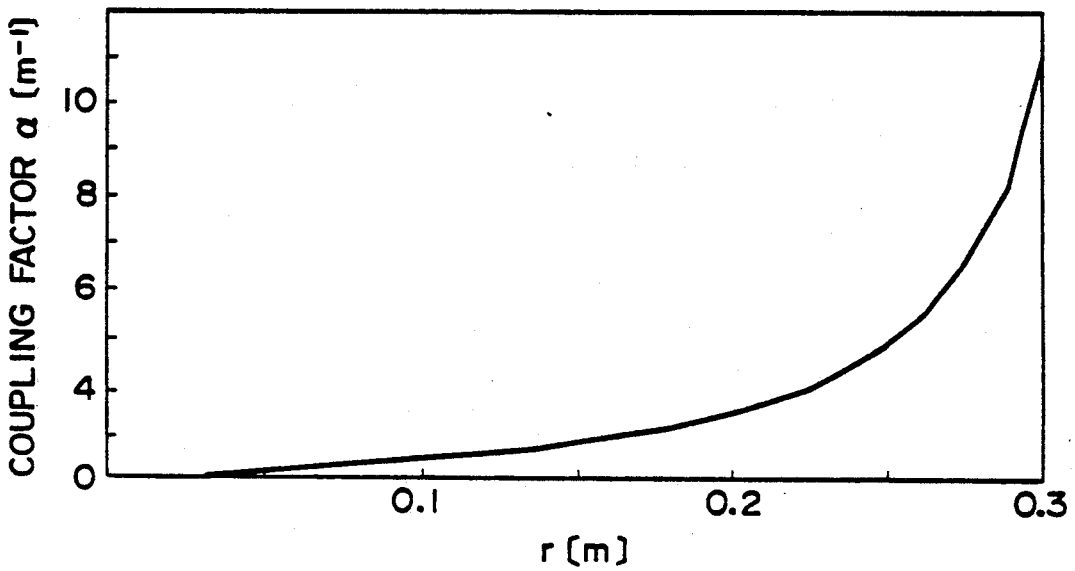
FIG. 4 is a distribution of coupling factor $\alpha$ as a function of the radius of a planar antenna for obtaining a flat aperture distribution.

The inventors have found that the coupling factor $\alpha$ can be adjusted while maintaining uniformity of the aperture field distribution by adjusting various parameters of the radiating slots 20A, 20B, namely length $S_L$ of the radiating slots 20A, 20B, distance Sr between adjacent slot pairs 20 in the radial direction, spacing Sa in the circumferential direction, and waveguide thickness (namely the spacing between the upper plate 12 and lower plate 14). For example, in case of an inner-feed-type planar antenna having a diameter of 60 cm, theoretically a uniform aperture distribution can be obtained within an allowable range if the coupling factor $\alpha$ is varied with respect to radius r as shown in FIG. 4. Specifically, in FIG. 4, radius (m) of the radiating surface of the planar antenna is plotted along the horizontal axis, and the coupling factor $\alpha$ ($m^{-1}$) is plotted along the vertical axis. By way of example, the coupling factor $\alpha$ is about 3 ($m^{-1}$) at the position of radius 0.2 m, and about 20 ($m^{-1}$) at the position of radius 0.3 m. In the equation, A represents an arbitrary constant, and k represents the wave number. For instance, the wave number is about $3.1\times10^2$ (rad/m) at 12 GHz.

Figure 5:
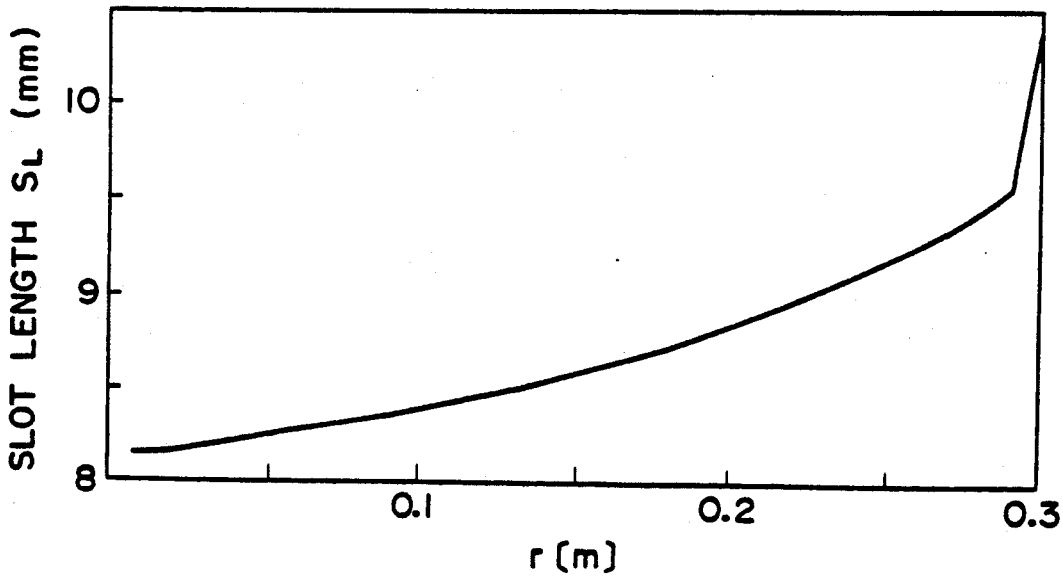
FIG. 5 is a distribution of slot length as a function of the radius of a planar antenna for obtaining the coupling factor distribution in FIG. 4.

In order to obtain such a coupling factor distribution, the length of the radiating slots 20A, 20B is varied with respect to r, as shown in FIG. 5. Specifically, in FIG. 5, the radius (m) of the radiating surface of the planar antenna is plotted along the horizontal axis, and slot length $S_L$ (mm) is plotted along the vertical axis. By way of example, the slot length $S_L$ is about 8.8 mm at the position of radius 0.1 m, and about 9.6 mm at the position of radius 0.2 m.

Figure 6:
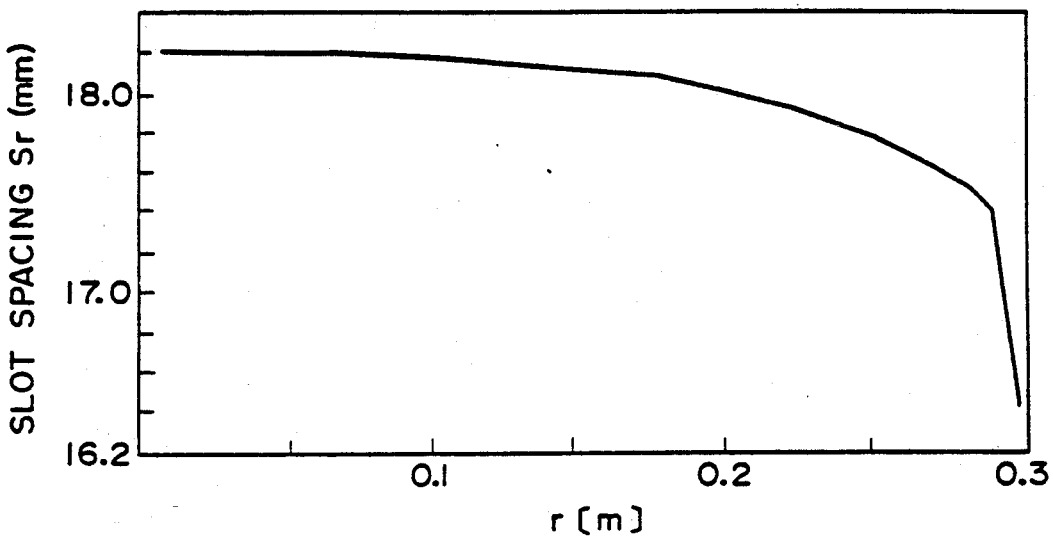
FIG. 6 is a distribution of slot spacing as a function of the radius of a planar antenna for obtaining the coupling factor distribution in FIG. 4.

The spacing Sr between adjacent radiating slot pairs 20 in the radial direction should be varied with respect to radius r as shown in FIG. 6. Specifically, in FIG. 6, the radius (m) of the radiating surface of the planar antenna is plotted along the horizontal axis, and the spacing Sr (mm) between adjacent radiating slot pairs in the radial direction is plotted along the vertical axis. By way of example, the spacing Sr between adjacent radiating slot pairs in the radial direction is about 21.0 mm at the position of radius 0.1 m, and about 19.5 mm at the position of radius 0.2 m.

That the coupling factor $\alpha$ theoretically obtained by such numerical computation agrees well with actual experimental values is reported by Jiro Hirokawa, Makoto Ando and Naohisa Goto in "An Analysis of Slot Coupling in a Radial Line Slot Antenna for DBS", ELECTRICAL SOCIETY, DATA OF THE ELECTROMAGNETIC THEORY RESEARCH GROUP, May 27, 1989.

Residual radio waves exist which are not radiated at the front surface in the course of propagating outward from the center. Though such residual radio waves may be absorbed by an absorber, it is preferred that these radio waves be radiated efficiently at the front surface, as will be described below. Specifically, based on the knowledge regarding an outerfeed-side, i.e., double-layered, planar antenna, it is known that radio waves can be reflected in the direction of the front surface of the antenna, with almost no reflection in the opposite direction, by a reflector whose surface is inclined at about 45°. In the present embodiment, therefore, a reflector 22 which orients a propagating radio wave in the forward direction is arranged at the outer circumferential portion of the planar antenna 10, and the upper plate 12 is provided with a spiral-shaped terminating slot 24 for radiating the reflected radio wave, which is reflected by the reflector 22, in the forward direction. The slot is thus formed as a spiral so that the radio waves radiated by the slot 24 also will be circularly polarized in the forward direction. Since it is required that this radiated wave have the same phase as the radio waves radiated by the radiating slot pairs 20, the terminating slot 24 has as a starting point one which is shifted radially a suitable distance from the spiral line of the radiating slot pairs 20. For example, one slot covering 360° in the angular direction, as shown in FIG. 1, will suffice. The reflector 22 is arranged along the slot 24. In the foregoing embodiment, the angle of inclination of the reflector is 45°. However, an optimum angle of inclination can be selected in dependence upon the height of the radial waveguide.

Though it is already known that circularly polarized radio waves are radiated from a spirally extending slot, it is difficult to finely adjust the amount of radio waves emitted. This is why radiation achieved by a number of slots was conceived. The terminating slot 24 of this embodiment does not require adjustment of the amount of radiation thereby, and it suffices to radiate all of the radio waves from the reflector 22. Therefore, it will suffice to adopt a slot having the conforming width.

Further, as shown in FIG. 4, the coupling factor $\alpha$ conveniently is very small at the central portion of the antenna surface. If the radiating slots 20A, 20B are not provided at the central portion of the antenna surface, the coupling factor $\alpha$ at this portion will become zero in extreme cases.

Figure 7:
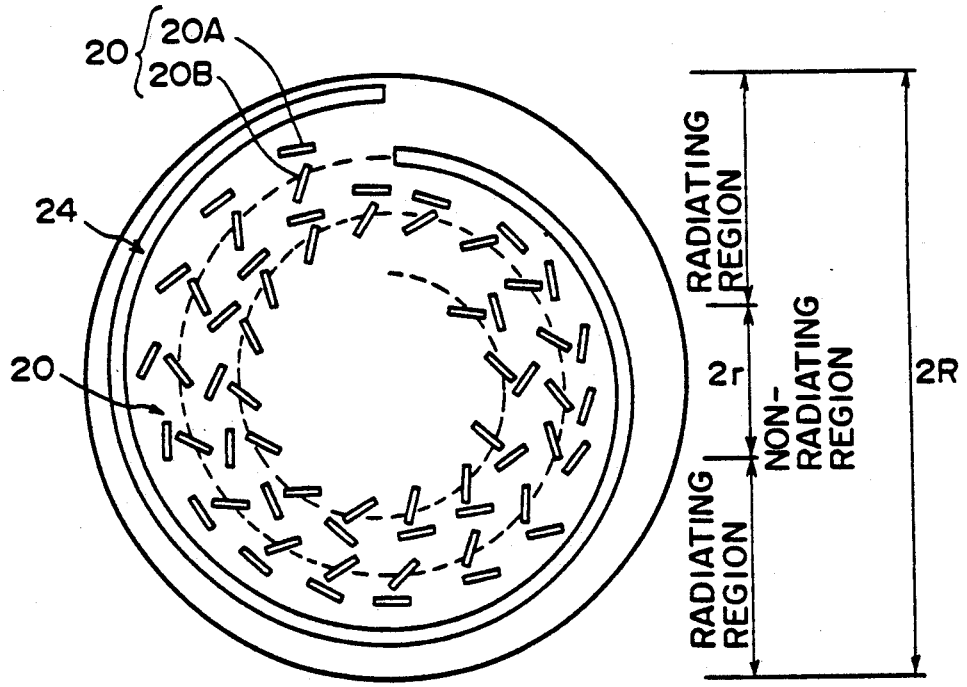
FIG. 7 is a front view of a planar antenna, the central portion of which is provided with a non-radiating region, illustrating a second embodiment of the present invention.

Accordingly, in a second embodiment of the present invention, the central portion of the antenna surface is made a non-radiating region in which no radiating slots 20A, 20B are provided. FIG. 7 is a front view of the second embodiment, in which a non-radiating region of radius r is provided at the center of the antenna surface, and the radiating slots 20A, 20B are provided on the outer periphery of the antenna surface so as to obtain the distribution of coupling factor $\alpha$ shown in FIG. 4. As a result of this arrangement, the coupling factor $\alpha$ is reduced completely to zero up to the radius r and defines a curve similar to that of FIG. 4 between the radius r and a radius R, as shown in FIG. 8.

Antenna gain G is substantially proportional to the area S of the radiating surface, namely the square of the antenna radius R. On the other hand, bandwidth B is approximately inversely proportional to the propagation distance of the waveguide, namely the antenna radius in a planar antenna excited with axial symmetry. The latter is due to the so-called long-line effect, in which the greater line length, the narrower the frequency band.

Figure 9:
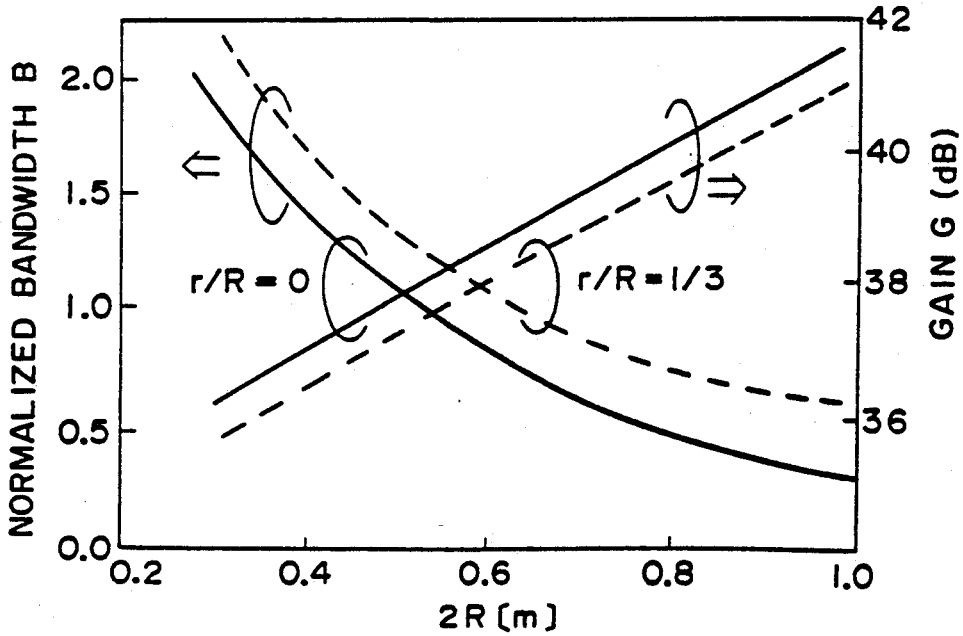
FIG. 9 is a characteristic diagram of the gain G and normalized bandwidth B of the planar antenna.

FIG. 9 is a graph showing the relationship between the antenna radius R and the radius r of the non-radiating region, and normalized bandwidth B and gain G. As illustrated, antenna area is reduced by the non-radiating region, but the radio wave propagation distance is shortened from the antenna radius R to (R-r), and the bandwidth is enlarged by the long-line effect. In other words, in order to cover the reduction in gain G caused by providing the non-radiating region, it will suffice to enlarge the antenna radius R so as to increase the radiating area by $\pi r^2$. However, the radio wave propagation distance (line length) is smaller than the original value (R) even at the increased antenna radius, and therefore a larger bandwidth B can be obtained. For example, if a non-radiating region having a diameter of 60 cm and a radius r of 10 cm is provided, bandwidth can be enlarged by about 1.3 times with a reduction in gain of only about 0.5 dB.

Figure 8:
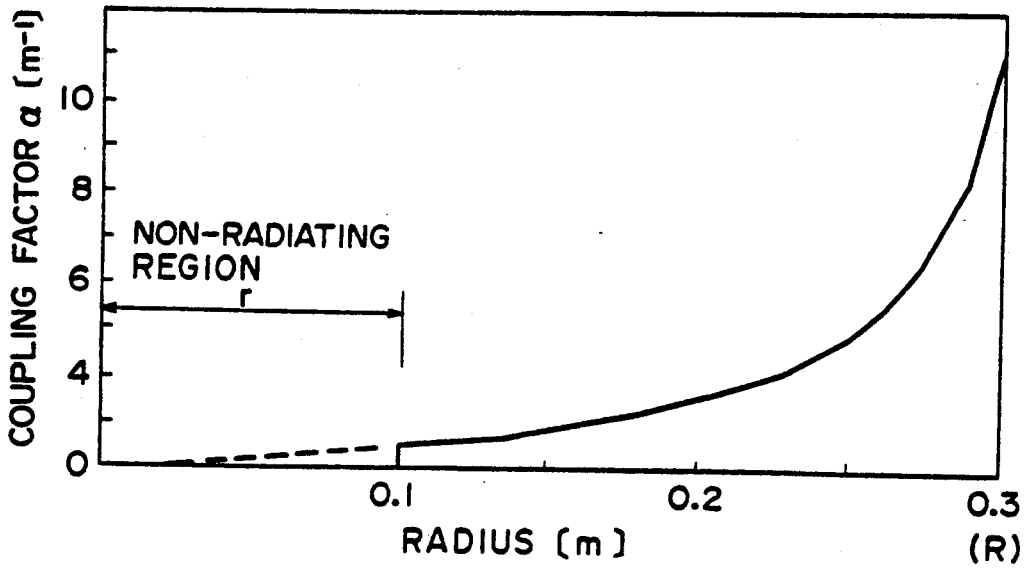
FIG. 8 is a distribution of coupling factors $\alpha$ in a case where a portion having a radius of 10 cm is adopted as a non-radiating region.

In FIG. 8, the coupling factor is given a stepshaped configuration at the point where the non-radiating region and radiating region contact each other, and is made to vary as the characteristic curve of FIG. 4 at other portions. However, the rise in this side lobe can be mitigated by gently varying the coupling factor. Accordingly, it is not always necessary to vary the coupling factor $\alpha$ in stepped fashion at the boundary of the non-radiating and radiating regions, as shown in FIG. 8. It will suffice if the coupling factor $\alpha$ is made to gradually approach the characteristic of FIG. 4 at the aforementioned boundary.

The arrangement in which the non-radiating region is provided at the center of the antenna surface as shown in FIG. 7 can be generally applied to an axially symmetric-mode, inner-excitation planar antenna, and this arrangement is not limited as to the type of polarization, such as circular polarization or linear polarization.

Thus, though the strong electromagnetic field at the central portion is a major factor impeding the formation of a uniform aperture distribution in a planar antenna of the inner-feed type, the present invention illustrates that a comparatively flat aperture distribution can be obtained by varying the coupling factor $\alpha$ in the radial direction. The shape and arrangement of the radiating slots can be modified in various ways.

Though a strong internal electromagnetic field at the central portion ordinarily makes it difficult to provide a uniform aperture distribution, an improvement is achieved by furnishing the central portion of the antenna surface with the non-radiating region. This improvement makes it easier to obtain a flat aperture distribution and makes it possible to enlarge the bandwidth.

By providing the terminating slot 24 at the outer peripheral portion and the reflector 22 along this slot 24, residual radio waves which have not been externally radiated in the course of propagation from the center to the outer periphery can be efficiently radiated at the front side of the antenna. As a result, a very high efficiency can be obtained.

In accordance with the present invention as described above, a single-layered, highly efficient planar antenna having an axially symmetric excitation mode can be provided. Since the radio-wave propagation layer need only be a single layer, the antenna can be manufactured at less cost than the double-layered planar antenna of outer-feed type.

A third embodiment of the present invention will now be described.

The terminating slot 24 described above is advantageous in that radio waves can be utilized effectively. However, in a case where antenna aperture is circular, the portion on the outer side of the terminating slot 24 is wasted area as far as the antenna is concerned.

Figure 12:
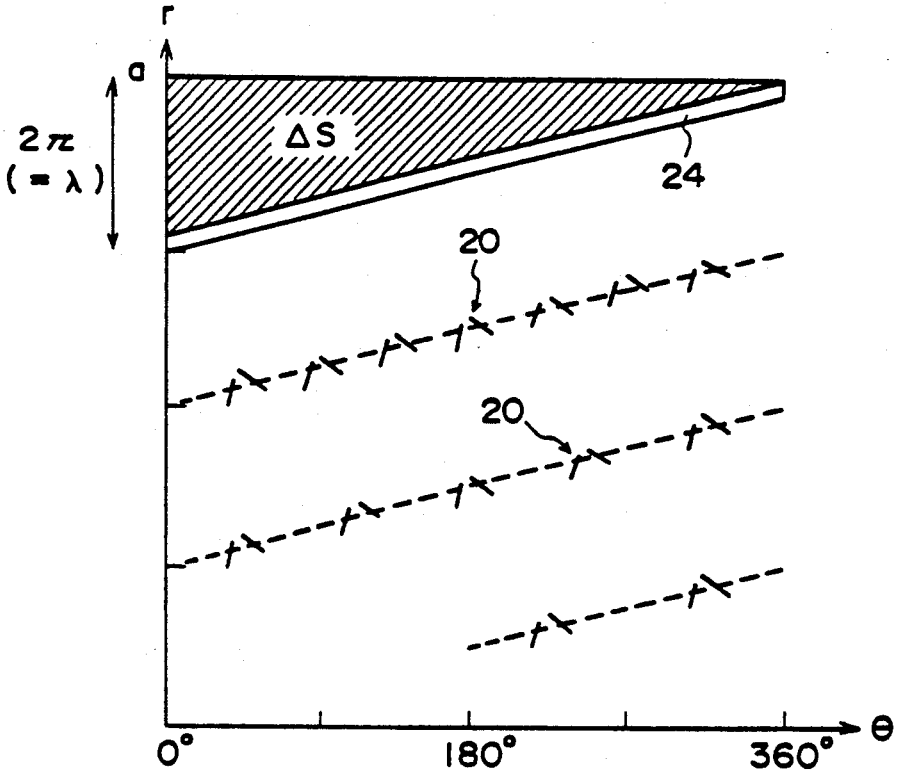
FIG. 12 is a diagram showing the arrangement of radiating slot pairs and a terminating slot in the r-$\theta$ plane (i.e., the antenna plane) of a cylindrical coordinate system (r,$\theta$,z) in which the front surface of the antenna is taken along the z axis.
Figure 13:
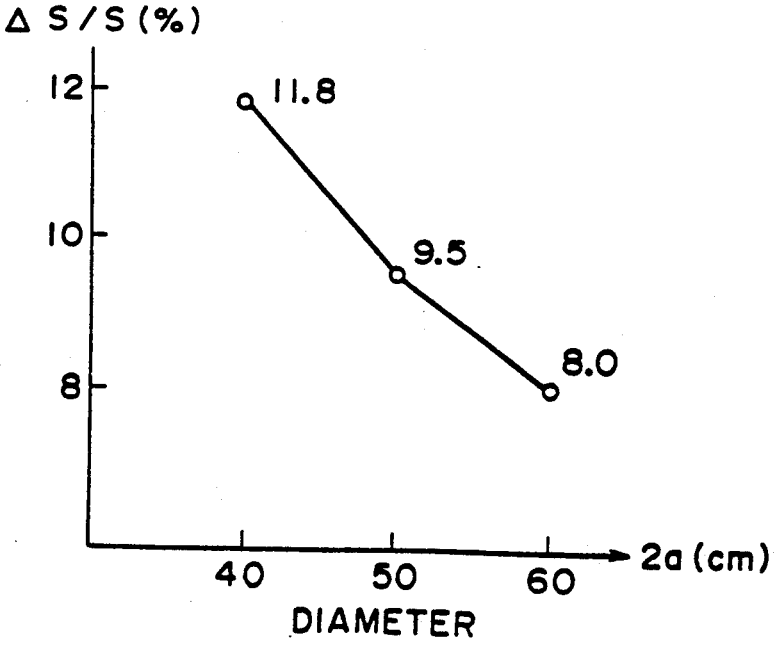
FIG. 13 is a diagram in which occupancy ratio $\Delta S/S$ of a wasted area $\Delta S$ to antenna area S is plotted with respect to antenna diameter.

FIG. 12 is a diagram showing the arrangement of the radiating slot pairs 20 and the terminating slot 24 in the r-$\theta$ plane (namely the antenna plane) of a cylindrical coordinate system (r,$\theta$,z) in which the front surface of the antenna is taken along the z axis. As shown in FIG. 12, the radiating slot pairs 20 are arrayed at radial positions proportional to the angle $\theta$ in the circumferential direction. These are arranged along a base line having a periodicity of $2\pi$ with respect to the direction of the radius r. The terminating slot 24 also occupies radial positions proportional to the angle $\theta$ in the circumferential direction. In a case where the upper plate 12 of the planar antenna 10 is formed as a disk of radius a, the area $\Delta S$ of the shaded portion in FIG. 12 does not act as part of the antenna and is a wasted portion. For example, in case of a frequency of 12 GHz (a wavelength of 25 mm), the occupancy ratio $\Delta S/S$ of $\Delta S$ (where $S=\pi a^2$) is 11.8% for a diameter of 40 cm, 9.5% for a diameter of 50 cm, and 8% for a diameter of 60 cm, as illustrated in FIG. 13.

Accordingly, in the present embodiment, it is arranged to obtain a planar antenna in which this wasted area $\Delta S$ does not occur.

This will now be described in detail.

Described first will be the basic approach of this embodiment.

As set forth earlier, the terminating slot 24 is made to extend along the extension line of the spiral line (base line) defining the positions of the radiating slot pairs 20. The reason for this is so that the radio waves radiated by the terminating slot 24 will be in phase with the radio waves radiated by the radiating slot pairs 20. Accordingly, if a dielectric material which adjusts the phase speed is disposed on the inner side of the terminating slot 24, by way of example, then elongation of the terminating slot 24 in the radial direction can be suppressed and the radius a of the planar antenna can be reduced.

Figure 14:
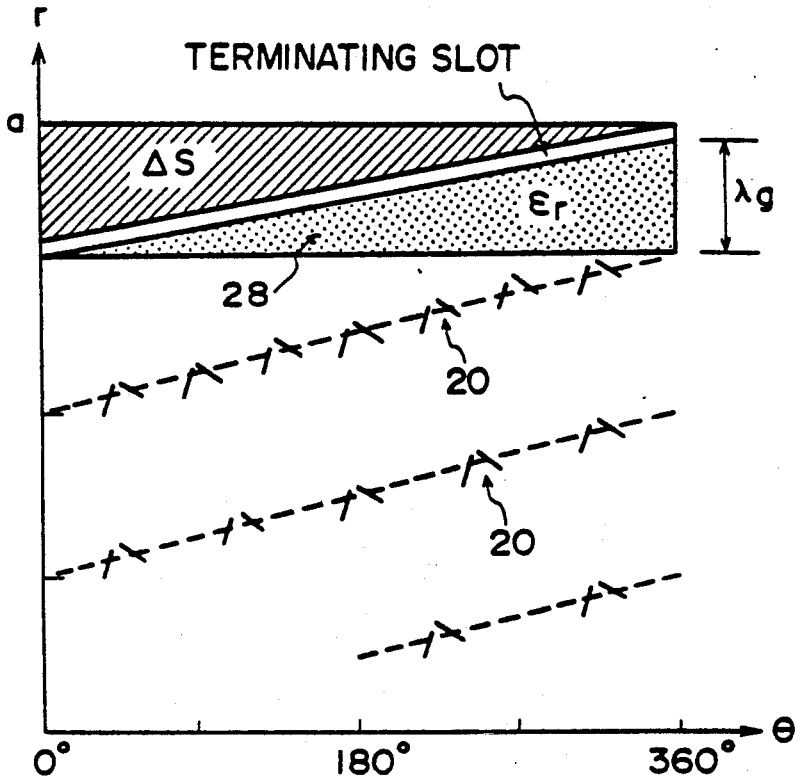
FIG. 14 is a diagram illustrating a third embodiment of the present invention and showing the arrangement of radiating slot pairs and a terminating slot in the r-$\theta$ plane of a cylindrical coordinate system (r,$\theta$,z) in which the front surface of the antenna is taken along the z axis, this antenna having a phase adjusting member comprising a dielectric material in which the propagation distance of a radio wave varies in dependence upon the angle in the circumferential direction.

For example, as shown in FIG. 14, a phase adjusting member 28 consisting of a dielectric material, the radio wave propagating distance of which varies in dependence upon the angle in the circumferential direction, is imbedded on the inner side of the terminating slot 24 in a portion ranging from radius a-r to radius a. Letting $\lambda$ represent wavelength and $\epsilon_r$ the specific dielectric constant of the phase adjusting member 28, the area $\Delta S$ of the portion on the outer side of the terminating slot 24 will be given by the following equation:

$$\begin{aligned} \Delta S &= [\pi a^2 - \pi (g - \lambda g)^2]/2 \\ &= \pi a^2 \cdot \lambda g/a \cdot [1 - (\lambda g/2a)] \\ \text{where } \lambda g &= \lambda/\sqrt{\epsilon_r} \end{aligned} \quad (1)$$

Figure 15:
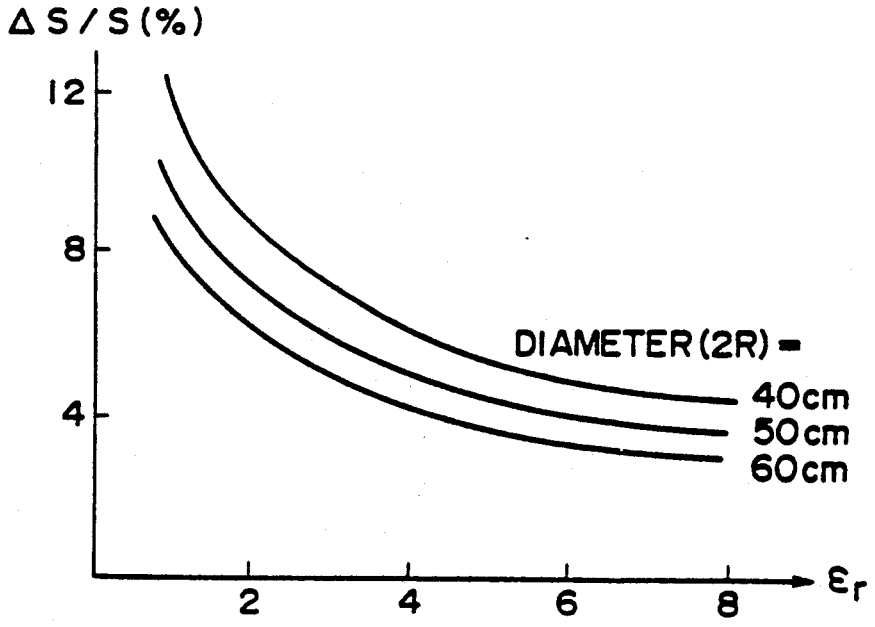
FIG. 15 is a diagram in which occupancy ratio $\Delta S/S$ of wasted area $\Delta S$ to antenna area S is plotted with respect to specific dielectric constant $\epsilon_r$.

It will be understood that the ratio $\Delta S/S$ of $\Delta S$ to the antenna area S ($=\pi a^2$) can be reduced by using a dielectric material having a high specific dielectric constant $\epsilon_r$, as shown in FIG. 15.

However, as illustrated in FIG. 14, $\Delta S$ cannot be made zero, i.e., the terminating slot 24 cannot be made circular, merely by disposing the phase adjusting member 28, the radio wave propagation distance whereof varies in dependence upon the angle $\theta$ in the circumferential direction, on the inner side of the terminating slot 24.

Accordingly, in this embodiment, the converse approach is adopted. Specifically, first the terminating slot is made circular, then a dielectric material whose radio wave propagation distance varies in dependence upon the angle $\theta$ in the circumferential direction is disposed in such a manner that a phase the same as that of the radio waves radiated by the radiating slot pair can be obtained even with this circular terminating slot. If the terminating slot is first designed to be circular, then the dielectric material for phase adjustment will be situated also below the radiating slot pairs inside the radial waveguide. Here the positions of the radiating slot pairs also will be adjusted in dependence upon the amount of change in phase produced by the dielectric material for phase adjustment.

Figure 16:
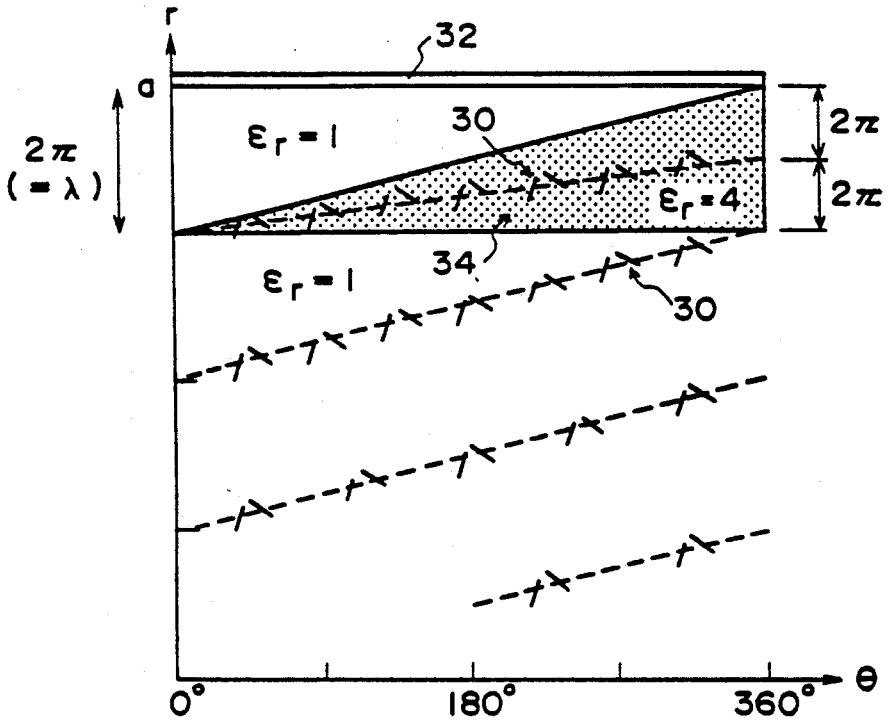
FIG. 16 is a diagram showing the arrangement of radiating slot pairs and a terminating slot in the r-$\theta$ plane of a cylindrical coordinate system (r,$\theta$,z) in which the front surface of the antenna is taken along the z axis, this antenna using a dielectric material, the specific dielectric constant $\epsilon_r$ of which is 4, as the phase adjusting member.

FIG. 16 is a diagram showing the slot arrangement in the r-$\theta$ plane of a cylindrical coordinate system (r,$\theta$,z) in an embodiment where a dielectric material (e.g., a ceramic), the specific dielectric constant $\epsilon_r$ of which is 4, is used as the phase adjusting member. Numeral 30 denotes a radiating slot pair having two radiating slots forming a pair similar to the radiating slot pair 20 described above. Except for the radiating slots 30 at the outermost periphery of the antenna, the slots are designed and arrayed in a configuration similar to that of FIG. 4. Numeral 32 denotes a terminating slot which radiates radio waves that have not been radiated by the radiating slots 30. The terminating slot 32 is a circular, ring-shaped slot having a ring-shaped aperture whose inner radius is a.

Numeral 34 designates the aforementioned phase adjusting member (where the specific dielectric constant $\epsilon_r=4$). In a range from a point $2\pi$ inward from the terminating slot 32, namely from a position at radius (a-$\lambda$), to the terminating slot 32 (namely the position at radius a), the phase adjusting member 34 has a radiowave propagation distance, namely a width, of zero at a position where the angle $\theta$ in the circumferential direction is zero. The width of the phase adjusting member 34 various continuously so as to attain a width of $\lambda$ at a position where the angle $\theta$ in the circumferential direction is 360°.

The radiating slot pairs 30 on the outermost periphery must be situated on a base line (spiral line) that is $2\pi$ inward from the terminating slot 32 and must be situated $2\pi$ outward from the base line (spiral line) defining the inwardly located radiating slot pairs 30. Further, the specific dielectric constant $\epsilon_r$ of the phase adjusting member 34 is 4, and the wavelength $\lambda g$ at this portion is as follows:

$$\lambda g = \lambda/\sqrt{\epsilon_r} = \lambda/2 \quad (2)$$

Therefore, the aforementioned phase conditions will be satisfied if the radiating slot pairs 30 at the outermost periphery are arrayed on a spiral line of radius a-$\lambda$ at a position where the angle $\theta$ in the circumferential direction is zero and of radius a-$\lambda/2$ at a position where the angle $\theta$ in the circumferential direction is 360°. Since the phase adjusting member 34 has a position and width as shown in FIG. 16 and the specific dielectric constant $\epsilon_r$ thereof is 4, the positions of the radiating slot pairs 30 at the outermost periphery thus can be decided mathematically in a simple manner.

Figure 17:
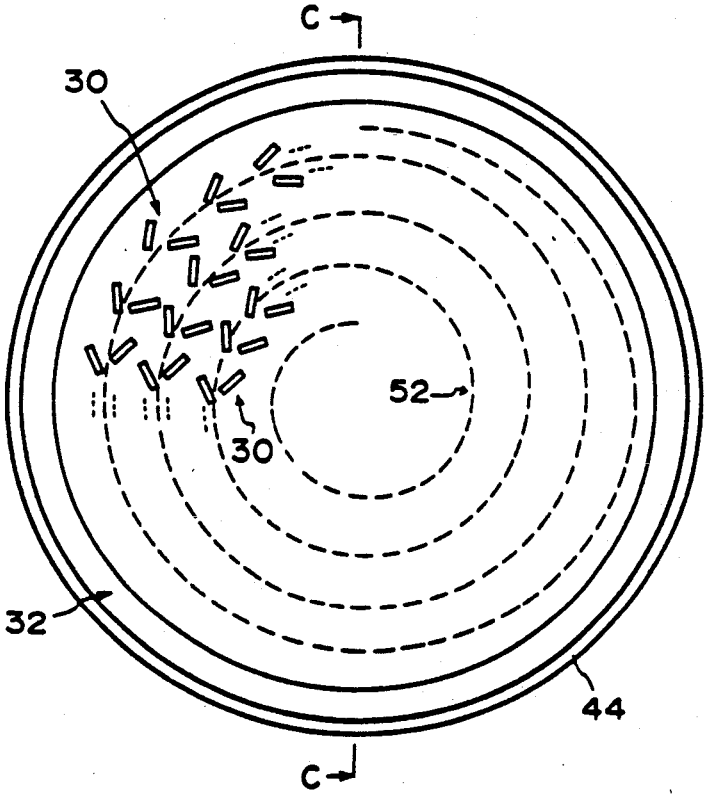
FIG. 17 is a generalized plan view showing a planar antenna designed based on the slot arrangement of FIG. 16.
Figure 18:
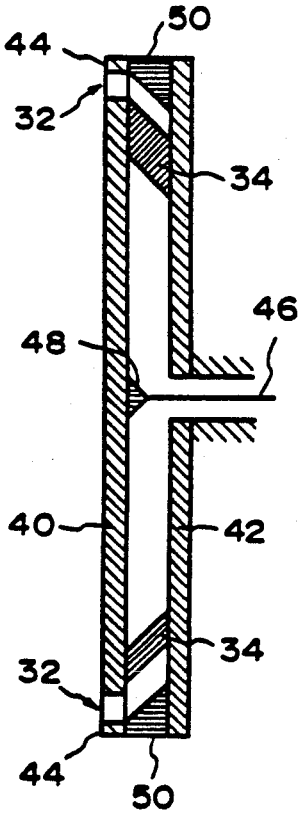
FIG. 18 is a sectional view taken along line C—C of FIG. 17.

FIG. 17 is a generalized plan view of a planar antenna designed based on the slot array of FIG. 16, and FIG. 18 is a sectional view taken along line C—C of FIG. 17. The radiating slot pairs 30 shown in FIG. 16 are illustrated at the same reference numerals with regard to the terminating slot 32 and phase adjusting member 34. This embodiment also is basically of a single-layered structure (see FIGS. 1 through 3) with the exception of the terminating slot 32, the radiating slot pairs 30, the position of the terminating slot 32 and the existence of the phase adjusting member 34.

A radial waveguide is formed by a circular upper plate 40 constituting the antenna surface and a circular lower plate 42 parallel to the upper plate 40 and spaced a predetermined distance away therefrom. An aperture formed between the inner edge of a ring-shaped disk 44 and the outer edge of the upper plate 40 serves as the terminating slot 32. The upper plate 40, lower plate 42 and ring-shaped disk 44 consist of an electrically conductive material. Though not illustrated, it is permissible for the upper plate 40 and ring-shaped disk 44 to be connected to each other at a suitable number of locations in a manner and using members not having much effect upon the antenna characteristics.

A coaxial cable 46 is connected to the center of the lower plate 42, and a conically shaped matching reflector 48, which causes radio waves from a coaxial cable 46 to be directed radially outward, is attached to the central portion of the upper plate 40 on the inner surface thereof (the surface facing the lower plate 42).

The width, namely the radio-wave propagation distance, of the phase adjusting member 34 varies in dependence upon the angular position in the circumferential direction, as shown in FIG. 16. However, as shown in FIG. 17, the end face at which radio waves enter and the end face at which radio waves exit are inclined at, e.g., 45°, in the traveling direction of the radios waves in order to avoid reflecting the radio waves.

A reflector (induction member) 50 for inducing the propagating radio waves in the direction of the terminating slot 32 is provided at the terminus portion on the radially outer side of the radial waveguide formed by the upper plate 40 and lower plate 42. Since the terminating slot 32 has the shape of a circular ring, the reflector 50 should be obtained by, for example, providing the inner circumferential surface of a circular, ring-shaped member with an incline of about 45° and machining this inclined surface to a radio-wave reflecting surface so as to minimize reflection toward the central side. Such a reflector can be manufactured very easily.

Though the interior of the radial waveguide formed by the upper plate 40 and lower plate 42 is completely hollow with the exception of the space occupied by the phase adjusting member 34, the interior can be completely or partially filled with a suitable dielectric material. In a case where the interior is filled with such a dielectric material, the specific dielectric constant of the phase adjusting member 34 is decided in a comparison with the equivalent specific dielectric constant of the dielectric material filling. Though the spacing between the upper plate 40 and lower plate 42 is maintained by the strength of the upper and lower plates 40, 42 themselves, the spacing can be maintained or reinforced by a suitable support member which will not have an adverse effect upon the propagation of the radio waves.

As described in connection with FIG. 16, the radiating slot pairs 30 are arranged on the upper plate 0. Of course, as illustrated in FIGS. 1 through 3, the lengths of the individual radiating slots constituting the radiating slot pairs 30, the distance Sr between adjacent slot pairs 30 in the radial direction, spacing Sa in the circumferential direction, and waveguide thickness (namely the spacing between the upper plate 40 and lower plate 42) are adjusted in order to obtain a uniform aperture distribution in practice. For reference, a base line 52 (spiral line) serving as a positional reference for the radiating slot pairs 30 is indicated by the dashed line in FIG. 17. Within the base line 52, the amount of change in the radial direction at the outermost one revolution is ½ that at the inner circumference. The reason for this is that the dielectric constant of the phase adjusting member 34 is 4.

Figure 19:
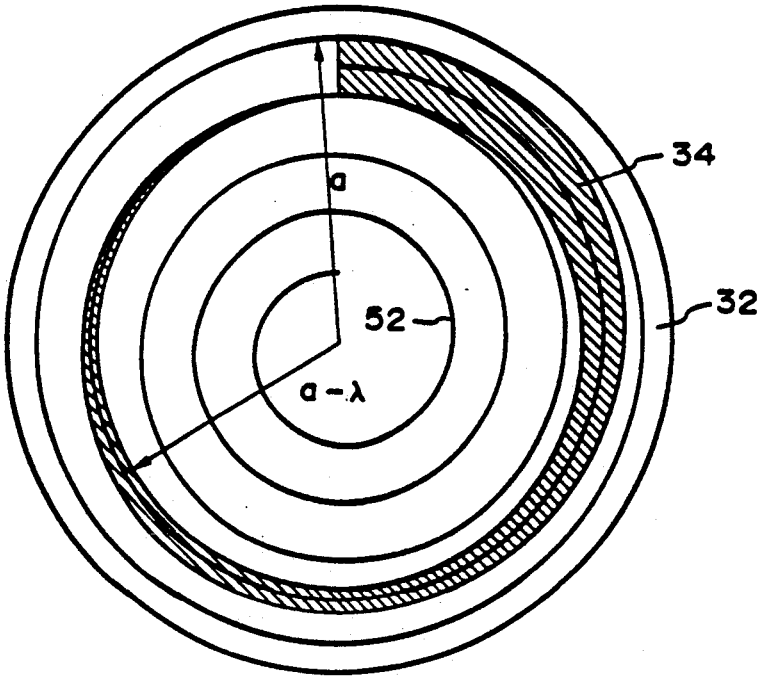
FIG. 19 is a diagram showing the positional relationship among a base line (spiral line) of the radiating slot pairs, the terminating slot and the phase adjusting member.

FIG. 19 illustrates the positional relationship among the base line 52 (spiral line) of the radiating slot pairs 30, the terminating slot 32 and the phase adjusting member 34. The phase adjusting member 34 is indicated by the hatching. In FIG. 17, the shape of the end face contacting the upper plate 40 is illustrated as the phase adjusting member 34. In order to facilitate an understanding of the embodiment, the phase adjusting member 34 is hatched. The end face of the phase adjusting member 34 on the inner side thereof is a circle of radius a-λ, and the end face on the outer side thereof defines a spiral line the radius of which changes from a-λ to a.

The operation of the planar antenna shown in FIGS. 17 and 18 will now be described in simple terms.

An electric signal for a radio-wave source, not shown, is supplied via the coaxial cable 46 to the interior of the radial waveguide formed by the upper plate 40 and lower plate 42, and the electric signal is propagated radially through the interior of the radial waveguide by the matching reflector 48. In the course of propagation, circularly polarized radio waves are radiated little by little at the front surface of the antenna by the radiating slot pairs 30. Radio waves that are phase-adjusted by the phase adjusting member 34 so as to be in phase with the radio waves emitted by the inner circumferential radiating slot pairs 30 are radiated at the outermost circumferential radiating slot pairs 30. Radio waves not radiated even by all the radiating slot pairs 30 pass through the phase adjustment member 34 almost without being reflected and are directed toward the terminating slot 32 by the reflector 50 to be radiated from the front side of the antenna. The radio waves that have passed through the phase adjusting member 34 become circularly polarized radio waves in concentric relation, with the center being the center of the antenna. Accordingly, the radio waves radiated from the terminating slot 32 are perfectly tuned to the circularly polarized waves produced by the radiating slot pairs 30.

In the embodiment described in FIGS. 16 through 19, the end face on the inner side of the phase adjusting member 34 is a circle of radius a-λ, and the end face on the outer side is a spiral line whose radius varies from a-λ to a. However, it is permissible for these end faces to have other shapes.

Figure 20:
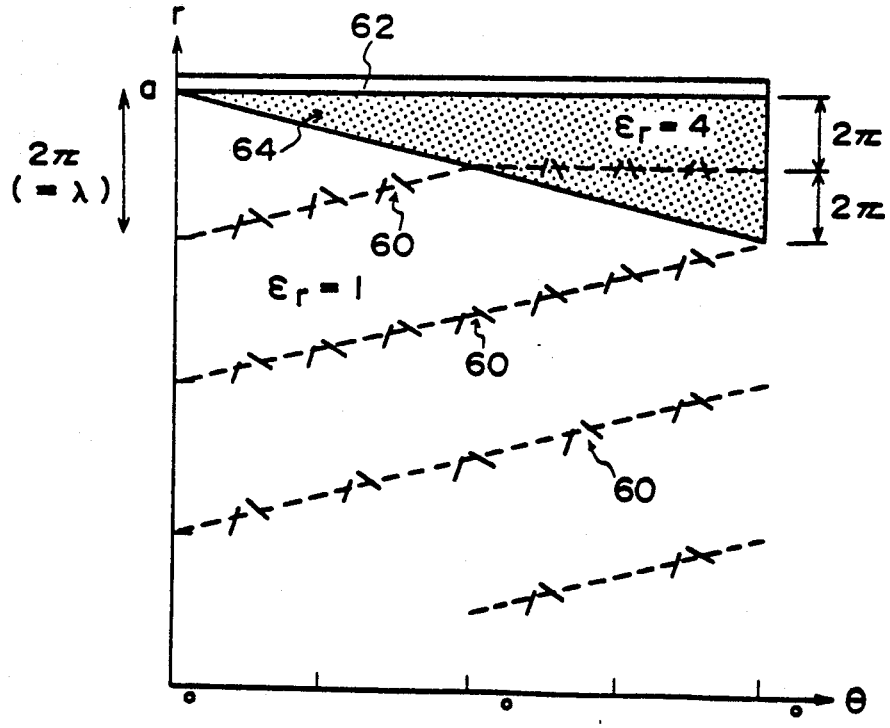
FIG. 20 is a diagram illustrating a fourth embodiment of the present invention and showing the arrangement of radiating slot pairs and a terminating slot in the r-$\theta$ plane similar to that of FIG. 16.

FIG. 20 illustrates a fourth embodiment of the present invention and is a diagram, similar to that of FIG. 16, showing the arrangement of slots in the r-$\theta$ plane. Numeral 60 denotes a radiating slot pair similar to the radiating slot pair 30, 62 a circular, ring-shaped terminating slot similar to the terminating slot 32, and 64 a phase adjustment member corresponding to the phase adjusting member 34. In this embodiment, the phase adjusting member 64 has a specific dielectric constant of 4, the inner end face thereof is a spiral line the radius of which varies from a (circumferential angle $\theta=0°$) to a λ circumferential angle $\theta=360°$), and the outer end face of which is a circle of radius a. In this case, the outermost circumferential radiating slot pairs 60 should be arrayed along a spiral line the radius of which varies from a-$\theta$ (λ=0°) to a-λ/2 ($\theta=180°$) where the circumferential angle $\theta$ ranges from 0° to 180°, and along a circle of radius a-λ/2 where the circumferential angle θ ranges from 180° to 360°.

According to these embodiments, a dielectric having a specific dielectric constant of 4 is used as the phase adjusting members 34, 64. However, this is merely one example, and it is obvious that a material having another specific dielectric constant can be used. In addition, though the inner and outer end faces of the phase adjusting members 34, 64 in these embodiments are curved surfaces in which the radial direction varies smoothly at the circumferential angle, one or both of them can of course approximate a polygonal shape. Furthermore, it is permissible to adopt an arrangement in which the amount of phase at the circumferential angle of the phase adjusting members 34, 64 is varied by changing the dielectric constant or the radio-wave propagation distance and the dielectric constant.

Figure 21:
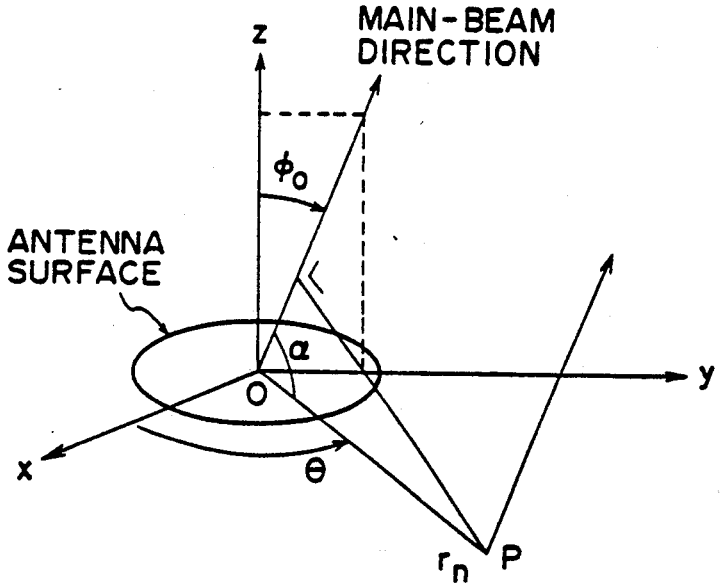
FIG. 21 is a diagram showing the coordinate system of an antenna.

In the foregoing embodiment, examples have been described in which the radio waves are radiated at the front side of the antenna. However, the present invention is applicable also to an antenna of beam-tilt type, in which radio waves are radiated from the front side of the antenna in a direction tilted at a predetermined angle. For example, as shown in FIG. 21, a case is considered in which, when the front surface of the antenna is taken along the z axis and the x, y axes are disposed on the antenna plane, a main beam is tilted in the y-z plane an angle $\phi_o$ from the z axis. In order for a radio wave emitted from the origin O (an imaginary wave serving as a reference) and a radio wave emitted after propagating from the origin O to a point P to have the same phase in the direction of the main beam, the following condition must be satisfied:

$$2\pi r_n/\lambda g - 2\pi r_n \cos \alpha/\lambda = 2(n+C)\pi + \theta \quad (3)$$

where C is a constant and n is a positive integer which is O at the innermost circumferential spiral and N at the outermost circumferential spiral.

Since the following holds:

$$\cos \alpha = \sin \phi_o \sin \theta \quad (4)$$

we have $$r_n = (n + C + \theta/2\pi)\lambda \cdot \lambda g/(\lambda - \lambda g \sin \phi_o \sin \theta) \quad (5)$$

Accordingly, $$r_{n=1} - r_n = \theta \cdot \lambda \cdot \lambda g/2\pi(\lambda - \lambda g \sin \phi_o \sin \theta) \quad (6)$$

Figure 22:
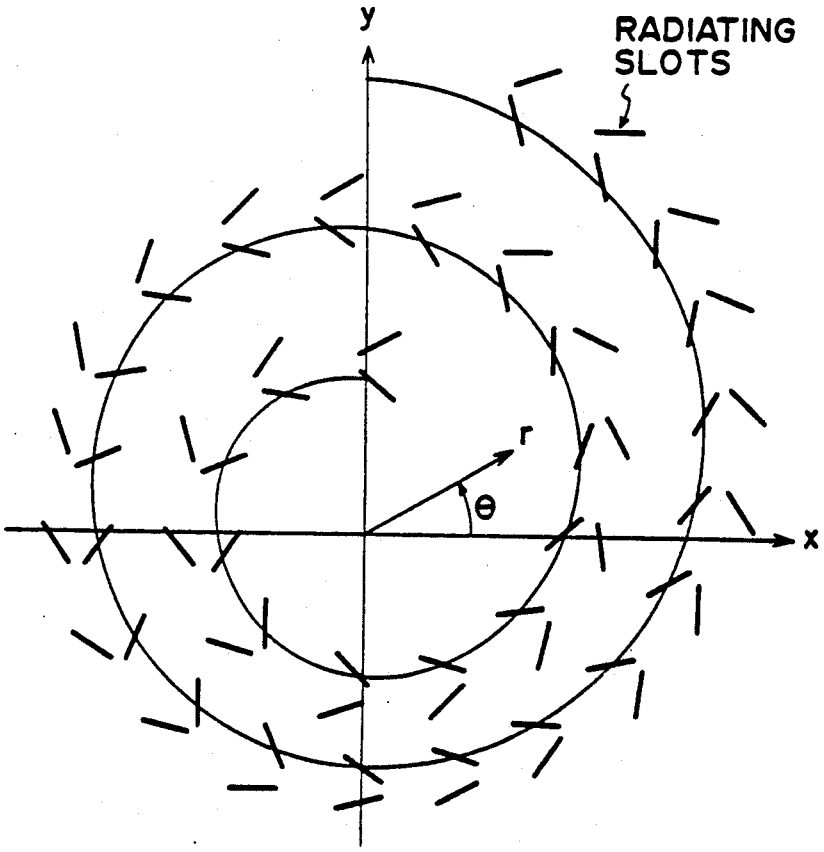
FIG. 22 is a diagram showing the arrangement of radiating slots in the plane of the antenna in this coordinate system.

It will be understood from Equation (5) that radiating slot pairs similar to the radiating slot pairs 20, 30 should be arrayed so as to be farther from the center along the +y axis and nearer to the center along the −y axis. Further, it will be understood from Equation (6) that the spiral spacing will not depend upon n. FIG. 22 illustrates the slot array in the antenna plane in this case.

Figure 23:
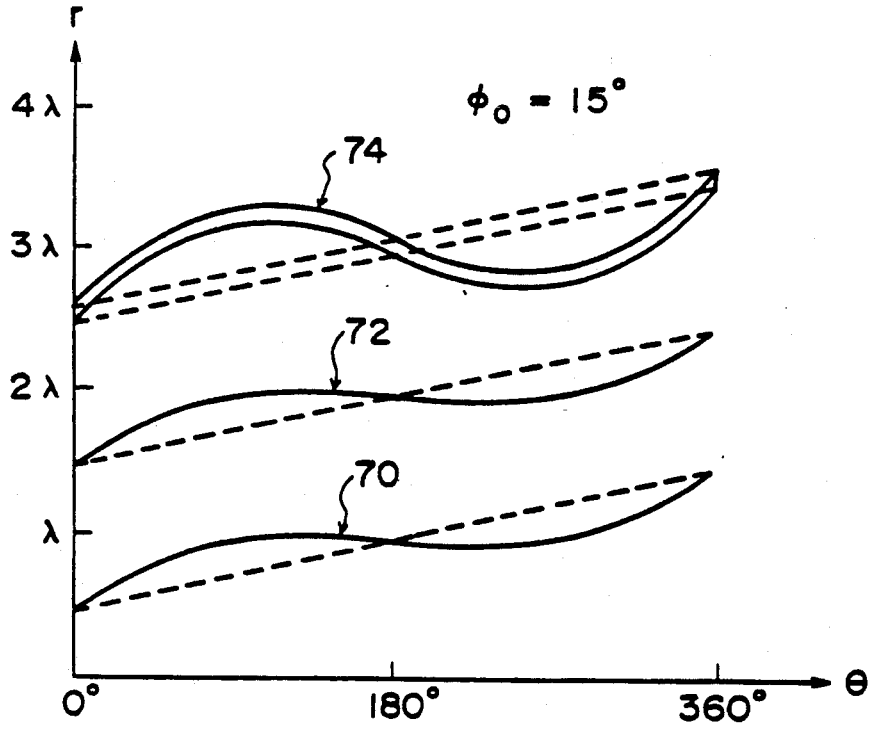
FIG. 23 is a diagram showing the arrangement of a terminating slot and radiating slot pairs in the r-$\theta$ plane in the case of a beam tilt-type (tilt angle $\phi_o = 15°$) planar antenna.
Figure 24:
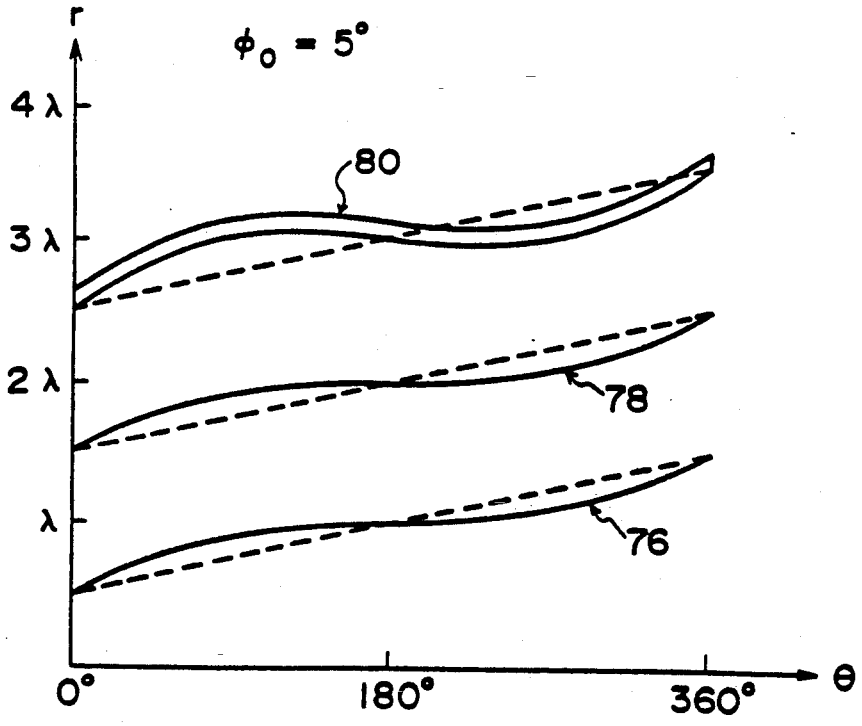
FIG. 24 is a diagram showing the arrangement of a terminating slot and radiating slot pairs in the r-$\theta$ plane in the case of a beam tilt-type (tilt angle $\phi_o=5°$) planar antenna.

When the radiating slot pairs in such a beam-tilt antenna are provided with the terminating slot described in FIGS. 1 through 3, the terminating slot also should be curved along a base line similar to that of the radiating slot pairs. FIGS. 23 and 24 illustrate the arrangement of the terminating slot and radiating slot pairs in the r-θ plane in the case of a beam-tilt antenna. For the sake of simplicity, tube wavelength λg is illustrated as being equal to spatial wavelength λ. FIG. 23 shows a case where tilt angle $\phi_o = 15°$, and FIG. 24 shows a case where tilt angle $\phi_o = 5°$. Basically, as will be understood from the foregoing description, the slots should be arrayed along curved lines which bulge in mutually opposite directions at portions where the circumferential angle θ is 90° or 270°. In FIG. 23, numerals 70, 72 denote base lines on which the radiating slot pairs are arrayed, and numeral 74 denotes the terminating slot. In FIG. 24, numerals 76, 78 denote base lines on which the radiating slot pairs are arrayed, and numeral 80 denotes the terminating slot.

Figure 25:
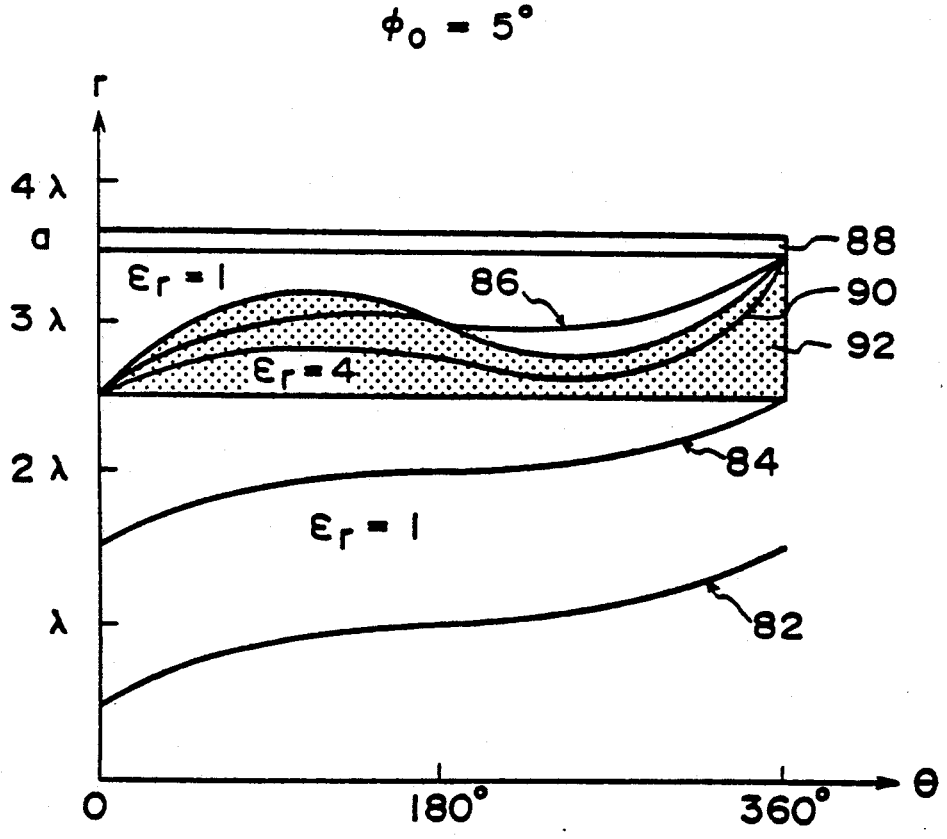
FIG. 25 is a diagram showing the arrangement of radiating slot pairs and a terminating slot in the r-$\theta$ plane of a cylindrical coordinate system (r,$\theta$,z) in which the front surface of the antenna is taken along the z axis, this being a case where the present invention is applied to the beam tilt-type planar antenna of FIG. 24.

FIG. 25 illustrates the slot array in the r-θ plane in a case where the present invention is applied to the beam-tilt planar antenna of FIG. 24. Numerals 82, 84 denote base lines on which radiating slot pairs corresponding to the radiating slot pairs 30 are arrayed, and numeral 88 denotes a terminating slot. Numeral 86 designates a base line for arraying the radiating slot pairs in a case where it is assumed that there is no phase adjusting member 92. The base lines 82, 84 coincide respectively with the base lines 76, 78 of FIG. 24.

Reference numeral 92 denotes a phase adjusting member arranged on the inner side of the terminating slot 88 in order to make the terminating slot 88 a true circle or a substantially true circle. As in the case of FIG. 16, a dielectric material having a specific dielectric constant $\epsilon_r$ of 4 is used, and the remaining portion is hollow (specific dielectric constant $\epsilon_r = 1$). The inner diameter of the phase adjusting member 92 is constant, and the outer diameter thereof varies in the circumferential direction. The width w of the phase adjusting member 92 in the θ direction is given by the following, as a function of the radius a of the terminating slot:

$$w = \lambda[(\theta/2\pi) + a \sin \theta \sin \phi/\lambda_o$$

The outermost circumferential radiating slot pairs are arrayed on base line 90 on the phase adjusting member 92. The base line 90 is obtained by reducing the base line 86 by ½ in the radial direction using the inner circumference of the phase adjusting member 92 as a reference. Basically, the positions of the base line 86 and the outer circumferential ends of the phase adjusting member 92 should be designed using an approach similar to that described in connection with the embodiment of FIG. 16.

A fifth embodiment of the present invention, namely one in which the planar antenna has phase adjusting means on the inner side of the terminating slot, will be described next.

In general, the circumstances of radio-wave propagation of a waveguide structure consisting of materials of different dielectric constants that are sufficiently thin in comparison with wavelength in the transverse direction of radio-wave propagation, and of a structure in which the transverse width of the waveguide varies in the radio-wave propagation direction, can be described theoretically by equivalent dielectric constants, and the matching conditions at the interface of varying equivalent dielectric constants also are known. Accordingly, even in the present invention, it is permissible to arrange it so that a plurality of dielectric layers are provided inside the radial waveguide and the transverse width of the waveguide is adjusted, thereby realizing, in equivalent terms, the phase adjusting function of the phase adjusting members 34, 64, 92.

Figure 26A:
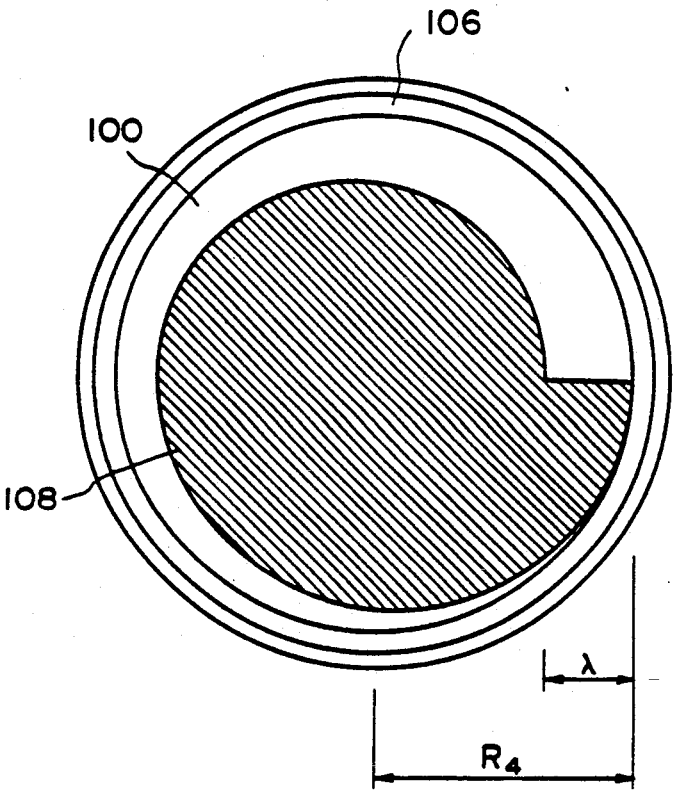
FIG. 26(*a*) is a plan view illustrating a fifth embodiment of the present invention and showing the principal portion of a planar antenna having phase adjusting means on the inner side of the terminating slot.
Figure 26B:
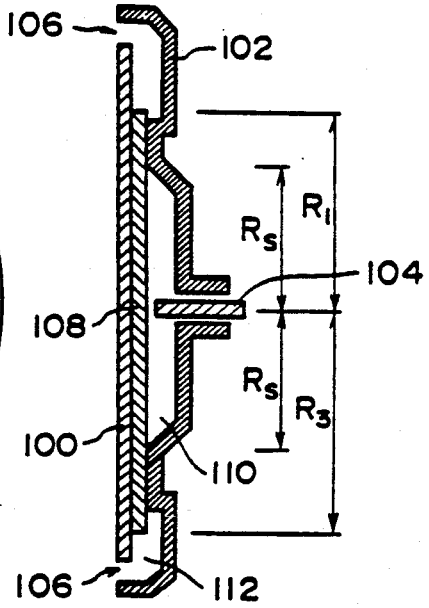
Figure 26C:
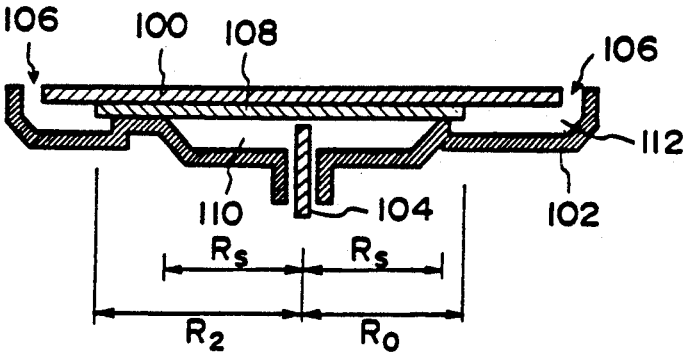

FIG. 26(*a*) is a front view of this fifth embodiment, FIG. 26(*b*) is a central sectional view, and FIG. 26(*c*) is a central transverse sectional view. The radiating slot pairs are deleted from FIG. 26(*a*). Numeral 100 denotes a slotted plate having a number of radiating slot pairs corresponding to the radiating slot pairs 30. This plate corresponds to the upper plate 40 of FIG. 16. Numeral 102 denotes a base plate which forms a radial waveguide between itself and the upper plate 100. This plate corresponds to the lower plate 42 of FIG. 16. Numeral 104 denotes a coaxial cable, and numeral 106 designates a terminating slot having the shape of a true circle or substantially true circle. This terminating slot corresponds to the terminating slot 32 (FIGS. 16, 17 and 18). Exciting radio waves from the coaxial cable are propagated radially outward through the radial waveguide formed between the slotted plate 100 and the the base plate 102. These radio waves are radiated outwardly from the radiating slot pairs, not shown, at the terminating slot 106.

A dielectric plate 108 the diameter of which enlarges in spiral fashion in dependence upon the circumferential angle is arranged inside the radial waveguide formed by the slotted plate 100 and base plate 102 Specifically, letting the radii at $\theta=0°$, 90°, 80°, 270°, 360° be represented by R0, R1, R2, R3, R4, respectively, we have $$R0<R1<R2<R3<R4$$

Though the details will be described later, the portion of the dielectric plate 108 lying outside radius R0 essentially functions as the phase adjusting member 34.

The thickness of the dielectric plate 108 is constant, and the peripheral edge face thereof is cut to a right angle. The dielectric plate 108 is illustrated by hatching in FIG. 26(*a*) so as to facilitate an understanding thereof. A plate material obtained by mixing or compounding and then forming a plurality of synthetic resins, by way of example, can be subjected to punching to form the dielectric plate 108. Such a plate having a specific dielectric constant of 4 to 6 can be easily and freely obtained.

A space 110 is provided between the dielectric plate 108 and base plate 102 in a region extending from the center to the fixed radius Rs. Radio waves propagate in accordance with an equivalent dielectric constant decided by the dielectric constant of the dielectric plate 108 and the dielectric constant of the space 110. Though the details will be described later, the width of the space 110 is gradually narrowed in such a manner that the radio waves are not reflected at all or very little by the matching conditions just short of the radius Rs. Eventually the width of the space 110 is made zero also for the purpose of supporting the dielectric plate 108. On the side outwardly of radius Rs, it is arranged so that radio waves propagate only through the dielectric plate 108 along the radio-wave propagation distance necessary for the phase adjusting member 34, and the transverse width of the radial waveguide is set so that there is no reflection or very little reflection by the matching conditions on the side located further outward. Radio waves that have passed through the dielectric plate 108 propagate through a space 112 and reach the terminating slot 106 from which they are radiated to the outside.

Figure 27A:
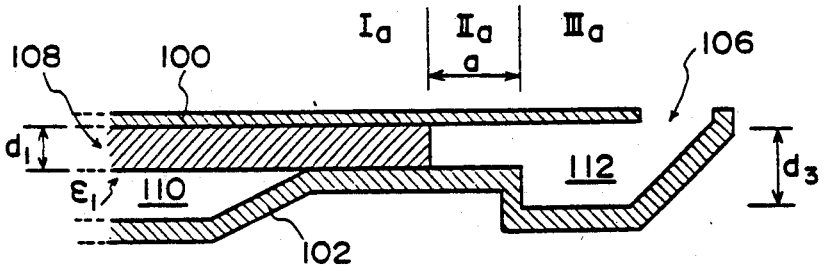
FIGS. 27(*a*) and 27(*b*) are transverse sectional views of waveguide regions for performing phase adjustment.
Figure 27B:
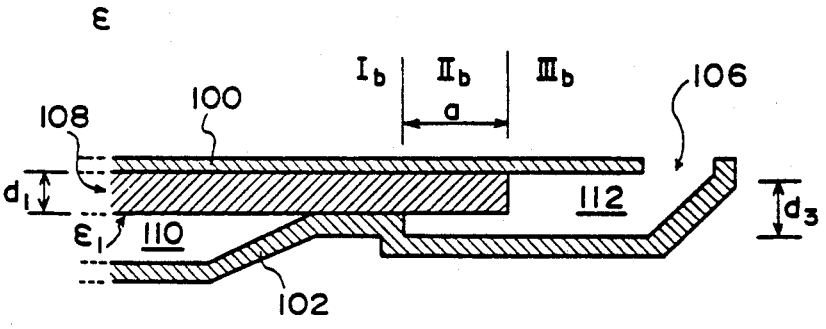
Figure 27C:
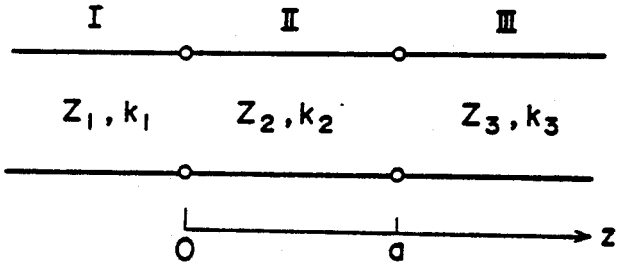

The radio-wave propagation conditions in the vicinity of radius Rs will now be simply described with reference to FIG. 27. For the sake of simplicity, a plane-wave approximation is made. FIGS. 27(*a*), (*b*) are transverse sectional views of waveguide regions which perform phase adjustment. FIG. 27(*b*) corresponds to the structure of FIG. 26. Either of FIGS. 27(*a*), (*b*) attain the object of the present invention. FIGS. 27(*a*) and 27(*b*) can be thought of as a transmission line of the kind shown in FIG. 27(*c*). Specifically, a region I in FIG. 27(*c*) corresponds to regions Ia, Ib in FIGS. 27(*a*), 27(*b*), a region II in FIG. 27(*c*) corresponds to regions IIa, IIb in FIGS. 27(*a*), (*b*), and a region III in FIG. 27(*c*) corresponds to regions IIIa, IIIb in FIGS. 27(*a*), (*b*).

In general, impedance Z of a transmission line is given by the following:

$$\begin{aligned} Z &= V/I \\ &= Ed/(Hw) \\ &= \eta d/w \\ &= dZ_0/\sqrt{\epsilon_e} \end{aligned} \tag{7}$$

where w (a constant) represents the width of the line, d the height of the line, and $\epsilon_e$ the equivalent dielectric constant of the line. Further, the wave number k is expressed by the following:

$$k = k_0\sqrt{\epsilon_e} \tag{8}$$

Accordingly, letting $\epsilon_1$ represent the specific dielectric constant of the dielectric plate 108, $d_1$ the thickness thereof, and d3 the transverse width of the radial waveguide in regions IIIa, IIIb, we have the following in the regions Ia and Ib of FIGS. 27(*a*) 27(*b*):

$$Z_1 = d_1Z_0/\sqrt{\epsilon_1} \tag{9}$$

$$k_1 = k_0\sqrt{\epsilon_1} \tag{10}$$

We have the following in the regions IIIa and IIIb of FIGS. 27(*a*) and 27(*b*):

$$Z_3=d_3Z_0 \tag{11}$$

$$k_3=k_0 \tag{12}$$

We have the following in the region IIa of FIG. 27(*a*):

$$Z_2=dZ_0 \tag{13}$$

$$k_2=k_0 \tag{14}$$

We have the following in the region IIb of FIG. 27(*b*):

$$Z_2 = d_3Z_0/\sqrt{\epsilon_{e2}} \tag{15}$$

$$k_2 = k_0\sqrt{\epsilon_{e2}} \tag{16}$$

From the concept of a capacitor series connection, we may write $$\epsilon_{e2}=(\epsilon_1d_3)/[\epsilon_1(d_3-d_1)+d_1] \tag{17}$$

The voltage and current in each region are as follows: Specifically, in regions Ia, Ib, $$V_1=AZ_1[\exp(-jk_1z)+R_1\exp(jk_1z)] \tag{18}$$

$$I_1=A[\exp(-jk_1z)-R_1\exp(jk_1z)] \tag{19}$$

In regions IIa, IIb, $$V_2 = BZ_2[\exp(-jk_2z) + R_2\exp(jk_2z)] \quad (20)$$

$$I_2 = B[\exp(-jk_2z) - R_2\exp(jk_2z)] \quad (21)$$

In regions IIIa, IIIb, $$V_3 = CZ_3\exp(-jk_3z) \quad (22)$$

$$I_3 = C\exp(-jk_3z) \quad (23)$$

At a point where z=0, namely at the boundaries of regions Ia, Ib and IIa, IIb, we may write $$[(1+R_1)/(1-R_1)] = [(1+R_1)/(1-R_1)]Z_2 \quad (24)$$

At a point where z=a, namely at the boundaries of regions IIa, IIb and IIIa, IIIb, we may write $$[1+R_2\exp(j2\theta)] = Z_3 \quad (25)$$

where $\theta = k_2a$. From Equation (25), we have $$R_2 = (Z_3 - Z_2)\exp(-j2\theta)/(Z_3 + Z_2) \quad (26)$$

Substituting this into Equation (24), we obtain the following:

$$(1 + R_1)/(1 - R_1) = (Z_2/Z_3) \cdot [Z_3 + Z_2 + (Z_3 - Z_2)\exp(-j2\theta)]/[Z_3 + Z_2 - (Z_3 - Z_2)\exp(-j2\theta)] \quad (27)$$

If it is assumed that only a radio wave which propagates radially outward exists in regions Ia and Ib, then $$R_1 = 0 \quad (28)$$

If this is substituted into Equation (27), the matching conditions become $$\theta = \pi/2 \quad (29)$$

$$Z_2^2 = A_1Z_3 \quad (30)$$

It will suffice if $d_1$, $d_3$, $\epsilon_1$, a are selected so as to satisfy these conditions.

An example of specific numerical values will now be given. In the case of FIG. 27(*a*), the length a of region IIa will be as follows for non-reflection and a frequency of 12 GHz when $\lambda/4$ holds from Equation (29):

$$a = \lambda/4 = 6.25 \text{ mm}$$

From the matching conditions of Equation (30), we have $$(d_1Z_0)^2 = d_1d_3Z_0^2/\sqrt{\epsilon_1} \quad (31)$$

Accordingly, we have $$d_3/d_1 = \sqrt{\epsilon_1} \quad (32)$$

If $\epsilon_1 = 4$, then $$d_3/d_1 = 2 \quad (33)$$

In case of FIG. 27(*b*), we have $$(d_3Z_0/\sqrt{\epsilon_{e2}})^2 = d_1d_3Z_0^2/\sqrt{\epsilon_1} \quad (34)$$

Accordingly, we have $$d_3 = (\epsilon_{e2}/\sqrt{\epsilon_1})d \quad (35)$$

From Equation (17) we obtain the following:

$$d_3 = d_1 + (\sqrt{\epsilon_1} - 1)d/\epsilon_1 \quad (36)$$

$$\epsilon_{e2} = (\epsilon_1 + \sqrt{\epsilon_1} - 1)/\sqrt{\epsilon_1} \quad (37)$$

If $\epsilon_1 = 4$, then $$d_3 = (5/4)d_1 \quad (38)$$

$$\epsilon_{e2} = 2.5 \quad (39)$$

At 12 GHz, we have the following:

$$a = \lambda/(4\sqrt{\epsilon_{e2}}) = 3.95 \text{ mm} \quad (40)$$

In FIGS. 26 and 27, an example is illustrated in which one dielectric plate 108 and the air layer 110 are stacked. As a matter of course, however, the present invention is not limited to this combination, for a plurality of layers can be stacked. If necessary, the height of the waveguide can be changed and the phase adjusting members 34, 64, 92 can be made to perform the same phase adjusting action. With such a waveguide structure, it is not very difficult to suppress or eliminate reflection at the portion where the dielectric constant changes in the radio-wave propagation direction, and the shape and dimensions of the regions matched are not limited to those of the above-described example. Further, as shown in FIG. 19, if the end face of the phase adjusting member 34 is slanted, this leads to difficult machining and higher manufacturing cost. In the embodiment of FIG. 26, manufacture is simplified greatly and can be achieved at lower cost.

The radiating slots of the radiating slot pairs 30, 60 and the terminating slots 32, 62, 106 need not be physical apertures so long as they are apertures as far as radio waves are concerned.

Figure 28:
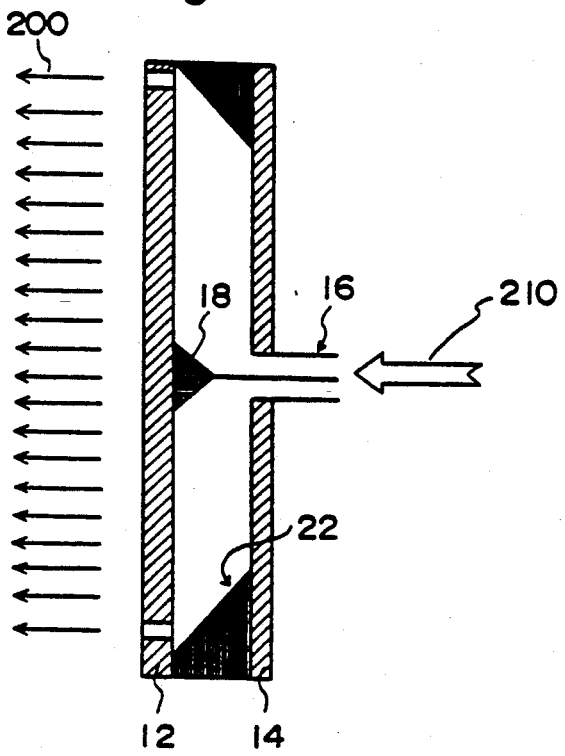
FIGS. 28 and 29 are views for describing a reciprocity theorem of a planar antenna according to the present invention.
Figure 29:
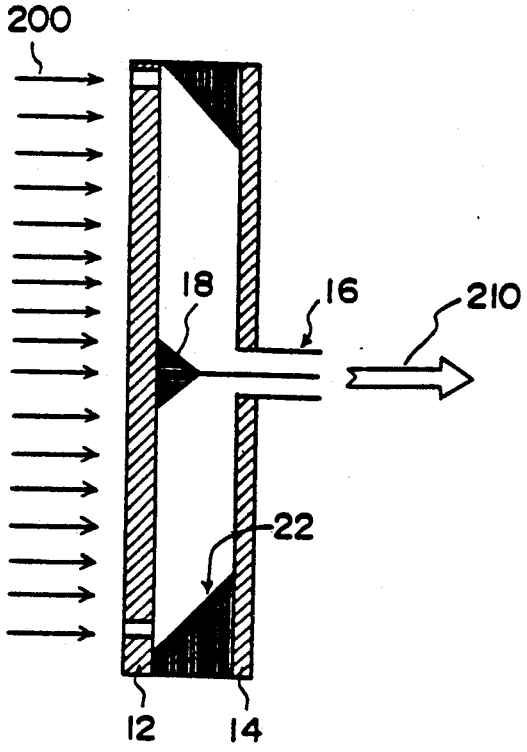

In the foregoing embodiments, cases in which radio waves are radiated from the antenna surface, namely in which radio waves are transmitted, are described as examples for the sake of explanation. However, the foregoing description will hold true even in a case where radio waves are received in accordance with an antenna reciprocity theorem. Specifically, as shown in FIG. 28, in a case where power 210 fed from the coaxial cable 16 is emitted as radiated power 200 from the antenna surface of the planar antenna 10 (see FIGS. 1 through 3), received power 210 can be outputted from the coaxial cable 16 when incident power 200 is received by the planar antenna 10 under the same conditions, as shown in FIG. 29.

This antenna reciprocity theorem is described in detail in, for example, "ANTENNA THEORY", InterUniversity Electronics Series, Vol. 7, McGraw-Hill Book Company, pp. 93–100.

Thus, as described in detail above, the present invention makes it possible to provide a single-layered planar antenna for transmission or reception in which the antenna surface is utilized highly efficiently. A compact planar antenna of a smaller size can be obtained.

The present invention is not limited to the foregoing embodiments but can be modified in various ways, such as with regard to the shape of the terminating slot, the shape of the phase adjusting member and the reflecting member, which is constituted by a 90° wall, based on the gist of the invention, and these modifications will not depart from the scope of the claims of the invention.

What is claimed is:

1. An inner-feed-type planar antenna of single-layered structure excited by an axially symmetric mode for propagating radio waves from the center toward an outer periphery within a propagation layer having an antenna surface, comprising:

(a) an axially symmetric mode waveguide member;

(b) radio-wave connecting means connected to the center of said axially symmetric mode waveguide member;

(c) a plurality of coupling slots formed in said antenna surface and following along a spiral curve on said antenna surface of said axially symmetric mode waveguide member wherein a proportional coefficient of radiation power per unit length in the radial direction is high at the outer periphery and becomes successively lower as the center is approached; and (d) a continuous spiral terminating slot following along said spiral curve, and provided in the antenna surface at an outer portion of said axially symmetric mode waveguide member, wherein a beginning portion of said continuous spiral terminating slot is located at a position on said spiral curve adjacent to a last slot among said plurality of coupling slots, and a terminating portion of said continuous spiral terminating slot is also disposed on said spiral curve.

2. The planar antenna according to claim 1, wherein there is provided a region in which the center of said axially symmetric mode waveguide member does not have said coupling slots.

3. The planar antenna according to claim 1, wherein there is provided a reflector member disposed along said continuous spiral terminating slot for reflecting propagating radio waves between inner and outer portions of said axially symmetric mode waveguide member,

4. The planar antenna according to claim 1, wherein there is provided a region in which the center of the antenna surface does not have said coupling slots, and a reflector member disposed along said continuous spiral terminating slot for reflecting propagating radio waves between inner and outer portions of said axially symmetric mode waveguide member.

5. The planar antenna according to claim 1, wherein said radio waves are transmitted from the antenna by a transmission source.

6. The planar antenna according to claim 1, wherein said radio waves are received by the antenna from a remote transmission source.

7. An inner-feed-type planar antenna of single-layered structure excited by an axially symmetric mode for propagating radio waves from the center toward an outer periphery within a propagation layer having an antenna surface, comprising:

(a) an axially symmetric mode waveguide member;

(b) radio-wave connecting means connected to the center of said axially symmetric mode waveguide member;

(c) a plurality of coupling slots formed in said antenna surface and following along a spiral curve on said antenna surface of said axially symmetric mode waveguide member wherein a proportional coefficient of radiation power per unit length in the radial direction is high at the outer periphery and becomes successively lower as the center is approached;

(d) a circular, ring-shaped slot provided in the antenna surface at an outer portion of said axially symmetric mode waveguide member; and (e) a phase adjusting member consisting of dielectric material disposed in a space between a front side and a rear side of said axially symmetric mode waveguide member and in the vicinity or the outer portion of said axially symmetric mode waveguide member for applying a predetermined amount of phase conforming to a circumferential angle.

8. The planar antenna according to claim 7, wherein an end face of an inner side of said phase adjusting member is formed in a circle of radius a-λ, and an end face of an outer side of said phase adjusting member is a spiral line whose radius varies from a-λ to a in said space of said axially symmetric mode waveguide member, wherein a represents the radius at the front side of said axially symmetric mode waveguide member, and λ represents the wavelength.

9. The planar antenna according to claim 7, wherein an end face of an inner side of said phase adjusting member follows along a spiral line whose radius varies from λ-a to a in said space of said axially symmetric mode waveguide member, and an end face of an outer side of said phase adjusting member is a circle of radius a, wherein a represents the radius at the front side of said axially symmetric mode waveguide member, and λ represents the wavelength.

10. An inner-feed-type planar antenna of single-layered structure excited by an axially symmetric mode for propagating radio waves from the center toward an outer periphery within a propagation layer having an antenna surface, comprising:

(a) an axially symmetric mode waveguide member;

(b) radio-wave connecting means connected to the center of said axially symmetric mode waveguide member;

(c) a plurality of coupling slots formed in said antenna surface and following along a spiral curve on said antenna surface of said axially symmetric mode waveguide member wherein a proportional coefficient of radiation power per unit length in the radial direction is high at the outer periphery and becomes successively lower as the center is approached;

(d) a circular, ring-shaped slot provided in the antenna surface at an outer portion of said axially symmetric mode waveguide member; and (e) at least three waveguide regions which, as seen from the center in the radial direction of said axially symmetric mode waveguide member, are a first waveguide region closest to the center, and having a first dielectric constant, a second waveguide region adjacent to and on a circumference of the first waveguide region, and having a second dielectric constant, and a third waveguide region adjacent to and on a circumference of said second waveguide region, and having a third dielectric constant;

(f) a phase adjusting member consisting of a dielectric plate, the diameter of which enlarges along a spiral curvature in dependence upon a circumferential angle from the center to the periphery of said waveguide member is arranged inside the radial waveguide formed by a slotted plate and a base plate of said waveguide member, in such a manner that said second dielectric constant being greater than said first dielectric constant, and said second dielectric constant applying a predetermined amount of phase, which conforms to a circumferential angle, to propagating radio waves.

11. A planar antenna according to claim 10, wherein a radial waveguide of said axially symmetric mode waveguide member has a matching region between said first waveguide region and said second waveguide region, and between said second waveguide region and said third waveguide region.

* * * * *